US006364637B1

(12) United States Patent
Hase et al.

(10) Patent No.: US 6,364,637 B1
(45) Date of Patent: Apr. 2, 2002

(54) AIR PUMP APPARATUS

(75) Inventors: Masahiro Hase, Tokyo; Kiyoshi Takahashi, 17-25 Hirai 7-chome, Edogawa-ku, Tokyo; Kazuo Takahashi, 17-3 Higashikasai 2-chome, Edogawa-ku, Tokyo, all of (JP)

(73) Assignees: Kiyoshi Takahashi; Kazuo Takahashi, both of Tokyo (JP)

( * ) Notice: Subject to any disclaimer, the term of this patent is extended or adjusted under 35 U.S.C. 154(b) by 0 days.

(21) Appl. No.: 09/564,294

(22) Filed: May 3, 2000

(30) Foreign Application Priority Data

Jun. 21, 1999 (JP) ..... 11-174040

(51) Int. Cl.[7] ..... F04B 17/00
(52) U.S. Cl. ..... 417/413.1
(58) Field of Search ..... 417/413.1, 538, 417/521

(56) References Cited

U.S. PATENT DOCUMENTS

| | | | | | |
|---|---|---|---|---|---|
| 4,154,559 | A | * | 5/1979 | Enomoto | 417/412 |
| 4,170,439 | A | | 10/1979 | Hase | |
| 4,608,000 | A | * | 8/1986 | Tominaga | 417/413 |
| 5,232,353 | A | * | 8/1993 | Grant | 417/413 R |
| 5,588,811 | A | * | 12/1996 | Price | 417/350 |
| 6,164,932 | A | * | 12/2000 | Tominaga et al. | 417/413.1 |

FOREIGN PATENT DOCUMENTS

| | | |
|---|---|---|
| JP | 92565626 | 12/1997 |
| JP | 2565626 | 10/1998 |
| JP | 63-46704 | 12/1998 |

* cited by examiner

*Primary Examiner*—Charles G. Freay
*Assistant Examiner*—William H Rodriguez
(74) *Attorney, Agent, or Firm*—Marshall & Melhorn, LLC

(57) ABSTRACT

An air pump apparatus that can allow easy change of the number of pump mechanisms contained therein and easy connection between the pump mechanisms is disclosed. The air pump apparatus comprises a pump mechanism and a pump case assembly forming an air-tight pump chamber in that the pump mechanism is contained. The pump mechanism comprises: a base frame; mutually opposing first and second diaphragms defining first and second diaphragm chambers on lateral sides of the base frame; electromagnetic drive means for driving the first and second diaphragms; first inlet and outlet ports connected to the first diaphragm chamber; and second inlet and outlet ports connected to the second diaphragm chamber, the second outlet port being in axial alignment with the first inlet port, wherein the first inlet port and the second inlet port of the first pump mechanism are in flow communication with outside of the first pump chamber, and the first outlet port and the second inlet port of the first pump mechanism are in flow communication with the first pump chamber. Preferably, the electromagnetic drive means comprises an electromagnet disposed longitudinally alongside the base frame and a pair of arms which are vibrated substantially symmetrically in accordance with alternation of a magnetic field generated by the electromagnet and connected to the first and second diaphragms respectively. Further preferably, a joint member for securing the pump mechanism(s) in the air pump apparatus is made of electrically conductive material so that electric power is supplied to the electromagnetic drive means of each pump mechanism via the joint member.

20 Claims, 14 Drawing Sheets

AIR PUMP APPARATUS

TECHNICAL FIELD

The present invention relates to an air pump apparatus for sucking and/or discharging air. Particularly, the present invention pertains to an air pump apparatus that is suitable for use in a vacuum suction type pick-up tool used in a clean room to pick up a semiconductor wafer or the like.

BACKGROUND OF THE INVENTION

Air pump apparatuses are conventionally used in picking up an object such as a semiconductor wafer by using vacuum suction or in scattering materials by using discharge function of the air pump apparatus. Such air pump apparatuses can be also used in aeration of water in an aquarium for keeping goldfish or other aquatic animals or plants. Thus, air pump apparatuses are used in a variety of fields.

Such an air pump apparatus is disclosed for example in U.S. Pat. No. 4,170,439, Japanese Utility Model Application Laid-Open (Kokai) No. 63-46704 or Japanese Utility Model Registration No. 2565626. The air pump apparatus disclosed in No. 2565626 comprises a plurality of diaphragms disposed in a pump chamber and the diaphragms are driven by an electromagnetic drive means utilizing an electromagnet and permanent magnet to conduct air inlet (suction) and air outlet (discharge) operations.

The diaphragm-type air pump apparatuses including those disclosed in the above publications have several advantages over the air pump apparatuses of other types: for example, the diaphragm-type air pump apparatuses can operate without oil and thus can avoid contaminating the surroundings; they tend to produce low noise and oscillation; and the constituent parts thereof have an extended lifetime, reducing the burdens in maintaining the diaphragm-type air pump apparatuses. Therefore, the diaphragm-type air pump apparatuses are suitable for such a use that requires functional steadiness of the pump for an extended period of time and in that contamination of the surroundings should be avoided, e.g., for use as a discharge pump for aeration of water in an aquarium or for use as a suction pump to pick-up a semiconductor wafer using vacuum suction.

In the prior art, however, when it became necessary to increase the pump capacity (or performance) beyond an adjustable range of a single pump apparatus (for example when the aquarium was replaced by a significantly larger one or when it became necessary to pick up a wafer having a significantly larger size and weight), either the entire pump apparatus had to be replaced by a new pump apparatus having a sufficiently high pump capacity or one or more additional pump apparatuses having a similar pump capacity had to be connected to the existing pump apparatus in series by using external piping.

In the former case, the user need to purchase an expensive high-capacity pump apparatus and has to find a new usage for the replaced pump apparatus or wastefully discard it while in the latter case, the external piping and additional power supply and control devices are necessary besides the additional pump main bodies, and they would not only make the total apparatus size considerably larger but also render the operation of the apparatus complicated. Also, the connection of the separate pump apparatuses using the external piping would be quite cumbersome and not readily achieved. Thus, in both cases, the user has to bear undesirable expenses and other burdens. On the part of pump apparatus manufacturers also, there was a problem that they had to provide various types of air pump apparatuses having different pump capacities, and this hindered simplification of the product management and cost reduction of the products.

BRIEF SUMMARY OF THE INVENTION

In view of such problems of the prior art and the recognition by the inventors, a primary object of the present invention is to provide an air pump apparatus that allows easy change of the number of pump mechanisms contained therein and easy connection between the pump mechanisms.

A second object of the present invention is to provide an air pump apparatus that allows addition of a pump mechanisms without considerable increase in the pump apparatus size.

A third object of the present invention is to provide an air pump apparatus that allows an easy electrical connection from the power source to the pump mechanisms contained in the pump apparatus as well as easy operation of the pump mechanisms.

A fourth object of the present invention is to provide a diaphragm-type pump mechanism adapted so as to be easily added to or removed from an air pump apparatus.

According to the present invention, these and other objects can be accomplished by providing an air pump apparatus, comprising: a first pump mechanism; and a pump case assembly forming a first air-tight pump chamber in that the first pump mechanism is contained, wherein the first pump mechanism comprises: a base frame having a first end and a second end opposite to the first end, the first and second ends of the base frame defining an axial direction of the air pump apparatus; mutually opposing first and second diaphragms defining first and second diaphragm chambers on lateral sides of the base frame respectively; electromagnetic drive means for driving the first and second diaphragms so as to expand and contract the first and second diaphragm chambers; a first inlet port defined in the first end of the base frame for communicating air into the first diaphragm chamber upon expansion of the first diaphragm chamber, with a first one-way valve being provided between the first inlet port and the first diaphragm chamber for permitting air flow only into the first diaphragm chamber; a second inlet port defined in the base frame for communicating air into the second diaphragm chamber upon expansion of the second diaphragm chamber, a second one-way valve being provided between the second inlet port and the second diaphragm chamber for permitting air flow only into the second diaphragm chamber; a first outlet port defined in the base frame for discharging air from the first diaphragm chamber upon contraction of the first diaphragm chamber, a third one-way valve being provided between the first outlet port and the first diaphragm chamber for permitting air flow only out of the first diaphragm chamber; and a second outlet port defined in the second end of the base frame for discharging air from the second diaphragm chamber upon contraction of the second diaphragm chamber, a fourth one-way valve being provided between the second outlet port and the second diaphragm chamber for permitting air flow only out of the second diaphragm chamber, and the second outlet port being in axial alignment with the first inlet port, and wherein the first inlet port and the second outlet port of the first pump mechanism are in flow communication with outside of the first pump chamber, and the first outlet port and the second inlet port of the first pump mechanism are in flow communication with the first pump chamber.

In the air pump apparatus constructed as above, since the pump mechanism is implemented as an independent unit, addition of a pump mechanism can be readily carried out.

The pump case assembly defining the air-tight pump chamber for containing the pump mechanism therein to make a pump unit comprising two series-connected diaphragm chambers can be easily modified in accordance with addition or removal of a pump mechanism. Since the diaphragm chambers are defined on lateral sides of the base frame of the pump mechanism, the pump mechanism has a relatively small axial size and thus achieving an air pump apparatus having a reduced axial length. This feature will be particularly preferable when achieving a multi-unit air pump apparatus comprising a plurality of series connected pump mechanisms. Further, since the first inlet port and the second outlet port of the first pump mechanism is in axial alignment, an additional pump mechanism having an identical configuration to the first pump mechanism can be quite easily aligned with and connected to the first pump mechanism without using an external pipe or the like, to thereby simplify the connection and achieve a compact air pump apparatus. Thus, the pump capacity of the pump apparatus can be varied in a wide range by changing the number of pump mechanisms contained in the air pump apparatus without replacing the entire air pump apparatus with another. This feature may be beneficial for both users and air pump manufactures in view of the cost.

Preferably, the pump case assembly comprises: a first case member including a base plate extending generally perpendicularly to the axial direction, the base plate having: a first surface on which the first pump mechanism is attached; a second surface opposite to the first surface; and a through-hole extending through the base plate at a position axially aligned with the first inlet port and the second outlet port of the first pump mechanism; and a second case member attached to the first case member so as to form the first air-tight pump chamber, the second case member being provided with a through-hole at a position axially aligned with the first inlet port and the second outlet port of the first pump mechanism, wherein the first inlet port of the first pump mechanism is in flow communication with outside of the first pump chamber via one of the through-holes provided to the base plate of the first case member and the second case member, and the second outlet port of the first pump mechanism is in flow communication with outside of the first pump chamber via the other of the through-holes provided to the base plate of the first case member and the second case member.

According to a preferred embodiment of the present invention, the first inlet port of the first pump mechanism is connected to the through-hole provided to the second case member, and the second outlet port of the first pump mechanism is connected to the through-hole provided to the base plate of the first case member.

Further preferably, the second surface of the base plate of the first case member is adapted so as to be capable of attaching thereto another pump mechanism having an identical configuration to the first pump mechanism with a first inlet port of the another pump mechanism being connected to the through-hole of the base plate of the first case member so that when the another pump mechanism is attached to the second surface of the base plate of the first case member, the second outlet port of the first pump mechanism and the first inlet port of the another pump mechanism are in flow communication via the through-hole of the base plate of the first case member. In this way, a second pump mechanism having an identical configuration to the first pump mechanism can be easily attached directly without using external piping or the like to the second surface of the base plate of the first case member with a first inlet port of the second pump mechanism being connected to the through-hole of the base plate of the first case member so that the first and second pump mechanisms are connected in series via the through-hole of the base plate.

If the pump case assembly further comprises a third case member attached to the first case member so as to form a second air-tight pump chamber for containing the second pump mechanism therein, the third case member being provided with a through-hole at a position axially aligned with a second outlet port of the second pump mechanism so that the through-hole is connected to the second outlet port of the second pump mechanism, and a first outlet port and a second inlet port of the second pump mechanism being in flow communication with the second pump chamber, a compact two-unit pump apparatus can be achieved easily and at low cost.

Similarly, a compact three-unit pump apparatus will be achieved easily and at low cost if the pump apparatus further comprises a third pump mechanism having an identical configuration to the first pump mechanism, and the pump case assembly further comprises: a third case member having an identical configuration to the first case member and axially aligned with the same so that a first surface of a base plate of the third case member faces the second surface of the base plate of the first case member, the third pump mechanism being attached to the first surface of the base plate of the third case member with a second outlet port of the third pump mechanism being connected to a through-hole of the base plate of the third case member; and a fourth case member interposed between the first and third case members, the fourth case member being attached to the first case member so as to form a second air-tight pump chamber for containing the second pump mechanism therein and attached to the third case member so as to form a third air-tight pump chamber for containing the third pump mechanism therein, wherein the fourth case member is provided with a through-hole at a position axially aligned with-a second outlet port of the second pump mechanism and a first inlet port of the third pump mechanism so that the through-hole is connected to both the second outlet port of the second pump mechanism and the first inlet port of the third pump mechanism and wherein a first outlet port and a second inlet port of the second pump mechanism are in flow communication with the second pump chamber while a first outlet port and a second inlet port of the third pump mechanism are in flow communication with the third pump chamber.

A four-unit pump apparatus can be achieve if the three-unit pump apparatus further comprises a fourth pump mechanism having an identical configuration to the first pump mechanism and attached to a second surface of the base plate of the third case member with a first inlet port of the fourth pump mechanism being connected to the through-hole of the base plate of the third case member, and the pump case assembly further comprises a fifth case member attached to the second surface of the base plate of the third case member so as to form a fourth air-tight pump chamber for containing the fourth pump mechanism therein, wherein the fifth case member is provided with a through-hole at a position axially aligned with a second outlet port of the fourth pump mechanism so that the through-hole is connected to the second outlet port of the fourth pump mechanism and wherein a first outlet port and a second inlet port of the fourth pump mechanism are in flow communication with the fourth pump chamber.

Thus, multi-unit pump apparatuses comprising different pump mechanisms connected in series can be achieved easily and at low cost by using common component parts and without external piping. In other words, the pump capacity of the pump apparatus can be varied in a wide range by changing the number of pump mechanisms contained in the air pump apparatus without replacing the entire air pump apparatus with another.

Preferably, the air pump apparatus comprises a lid member disposed at an axial end of the air pump apparatus, the lid member comprising: an air chamber holding a filter therein; and an air passage having one end connected to the air chamber and the other end connected to outside of the air pump apparatus. If the air chamber of the lid member is axially aligned with the first inlet port and the second outlet port of the first pump mechanism, the air chamber can be easily connected without using additional pipe or the like to the first inlet port or the second outlet port of an adjacent pump mechanism. Thus, by disposing the lid member such that air is taken into the air pump apparatus via the air passage and the filter of the lid member, small particles or the like can be prevented from entering the air pump apparatus. If the lid member is disposed such that air is discharged from the air pump apparatus via the filter and the air passage of the lid member, it is possible to prevent the air pump apparatus from discharging small particles or the like. Such an air pump apparatus is suitable for use in a clean room or the like where contamination of the surroundings should be avoided. In view of facilitating connection of an external device such as a tube, nozzle or the like to the air passage in the lid member, it may be preferable if the air passage of the lid member extends generally perpendicularly to the axial direction so that the other end of the air passage is located (or opened) on a side of the air pump apparatus.

Further, in view of facilitating the electrical connection for the pump mechanism(s) in the air pump apparatus, it will be beneficial if an axially extending joint member for securing the pump mechanisms in the air pump apparatus is made of electrically conductive material so that electric power is supplied to the electromagnetic drive means of each pump mechanism via the joint member. In this way, separate parts for establishing an electric path to the electromagnetic drive means becomes unnecessary, simplifying the configuration of the air pump apparatus and facilitating the assembly of the same. Particularly in a multi-unit pump apparatus comprising more than one pump mechanisms, electric power can be supplied from a common power source to the electromagnetic drive means of each pump mechanism via the joint member so that the pump mechanisms can be controlled simultaneously by a common operation switch.

In view of achieving an air pump apparatus having a reduced axial length, the electromagnetic drive means of the first pump mechanism preferably comprises an electromagnet disposed longitudinally alongside the base frame and a pair of arms which are vibrated substantially symmetrically in accordance with alternation of a magnetic field generated by the electromagnet and connected to the first and second diaphragms respectively. The symmetrical vibration of the pair of arms is also preferable in view of low noise generation.

In a preferred embodiment of the present invention, the second inlet port of the first pump mechanism is defined in the first end of the base frame and the first outlet port of the first pump mechanism is defined in the second end of the base frame so that the first and second inlet ports are defined in the same end of the base frame of the pump mechanism while the first and second outlet ports are defined in the same end of the base frame. Such a port arrangement may be also preferable in view of the reduced axial size of the air pump apparatus.

In view of facilitating the attachment of the pump mechanism(s) to the pump case member, it will be preferable if the through-hole of the base plate of the case member is defined by a tubular port having a first edge axially projecting from the first surface of the base plate of the first case member and a second edge axially projecting from the second surface of the base plate of the first case member, the first edge of the tubular port being adapted to be fittingly engageable with the second outlet port of the first pump mechanism and the second edge of the tubular port being adapted to be fittingly engageable with the first inlet port of the another pump mechanism. In this way, the connection of the inlet or outlet port of the pump mechanism to the through-hole of the pump case member can be facilitated and ensured.

According to another aspect of the present invention, there is provided a diaphragm-type pump mechanism, comprising: a base frame having a first end and a second end opposite to the first end, the first and second ends defining an axial direction of the pump mechanism; a diaphragm defining a diaphragm chamber in the base frame; an electromagnetic drive means for driving the diaphragm so as to expand and contract the diaphragm chamber, an inlet port defined in the first end of the base frame for communicating air into the diaphragm chamber upon expansion of the diaphragm chamber, with a first one-way valve being provided between the inlet port and the diaphragm chamber for permitting air flow only into the diaphragm chamber; an outlet port defined in the second end of the base frame for discharging air from the diaphragm chamber upon contraction of the diaphragm chamber, a second one-way valve being provided between the outlet port and the diaphragm chamber for permitting air flow only out of the diaphragm chamber, wherein the inlet port and the outlet port are in axial alignment with each other, and the electromagnetic drive means is disposed alongside the base frame.

Such a pump mechanism can be contained in an air-tightly sealed pump chamber to make a pump unit comprising series-connected two diaphragm chambers. Since the electromagnetic drive means is disposed alongside the base frame, the pump mechanism has a relatively small axial length and thus is suitable for achieving a multi-unit pump apparatus comprising more than one series-connected such pump mechanisms.

Preferably, the diaphragm defines the diaphragm chamber on a lateral side of the base frame and wherein the electromagnetic drive means comprises an electromagnet disposed longitudinally alongside the base frame and an arm vibrated in accordance with alternation of a magnetic field generated by the electromagnet and connected to the diaphragm.

BRIEF DESCRIPTION OF THE DRAWINGS

Now the present invention is described in the following with reference to the appended drawings, in which.

DETAILED DESCRIPTION OF THE PREFERRED EMBODIMENTS

Now the present invention is described in the following in more detail in terms of concrete embodiments with reference to the appended drawings. In the following, it should be noted that the terms such as "horizontally" and "vertically" are used with respect to the drawings for illustration purposes only and should not be considered as restricting the invention.

Figure 1:
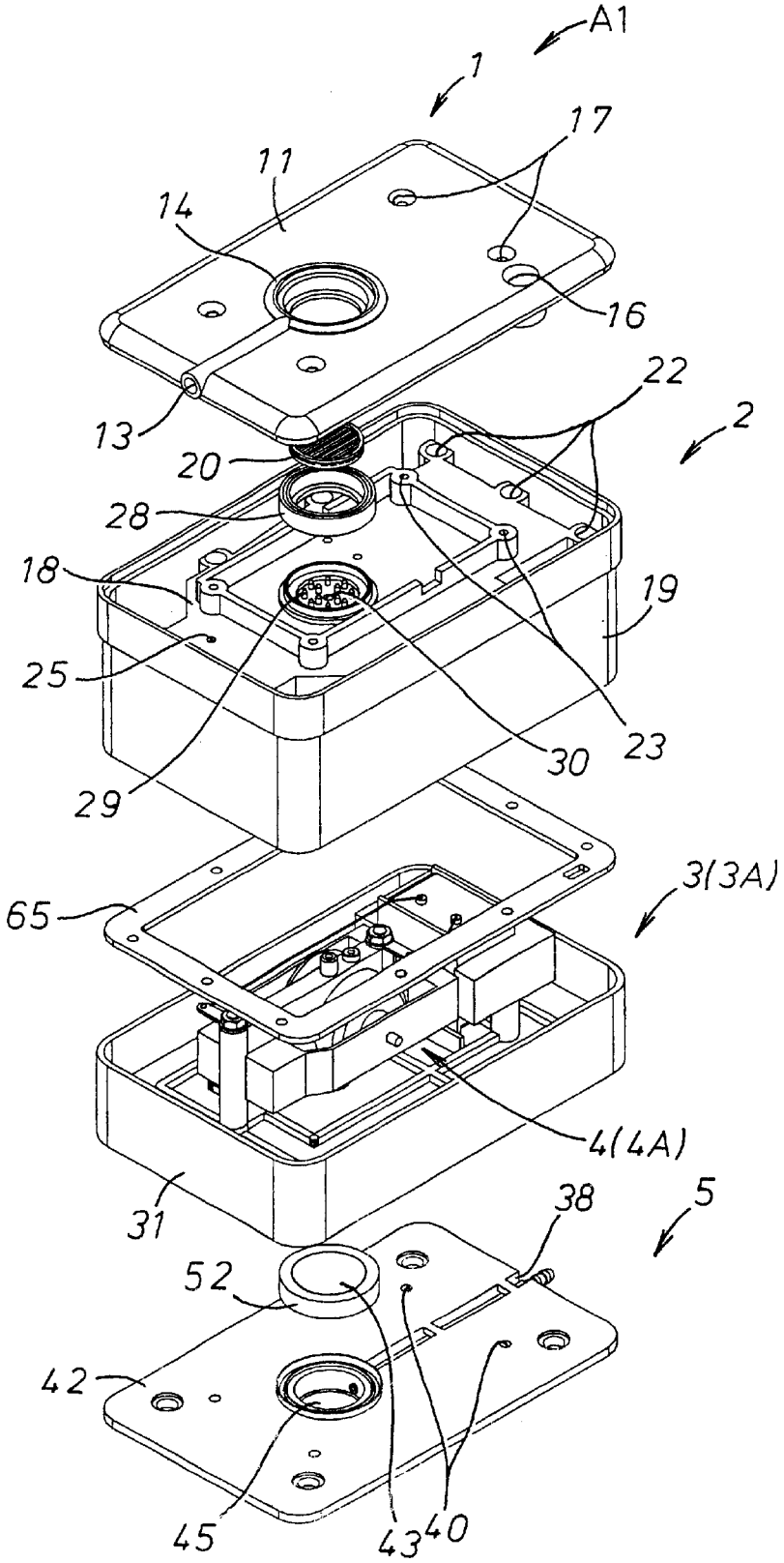
FIG. 1 is an exploded perspective view for showing a one-unit pump apparatus A1 that is a basic form of an air pump apparatus according to the present invention.
Figure 2:
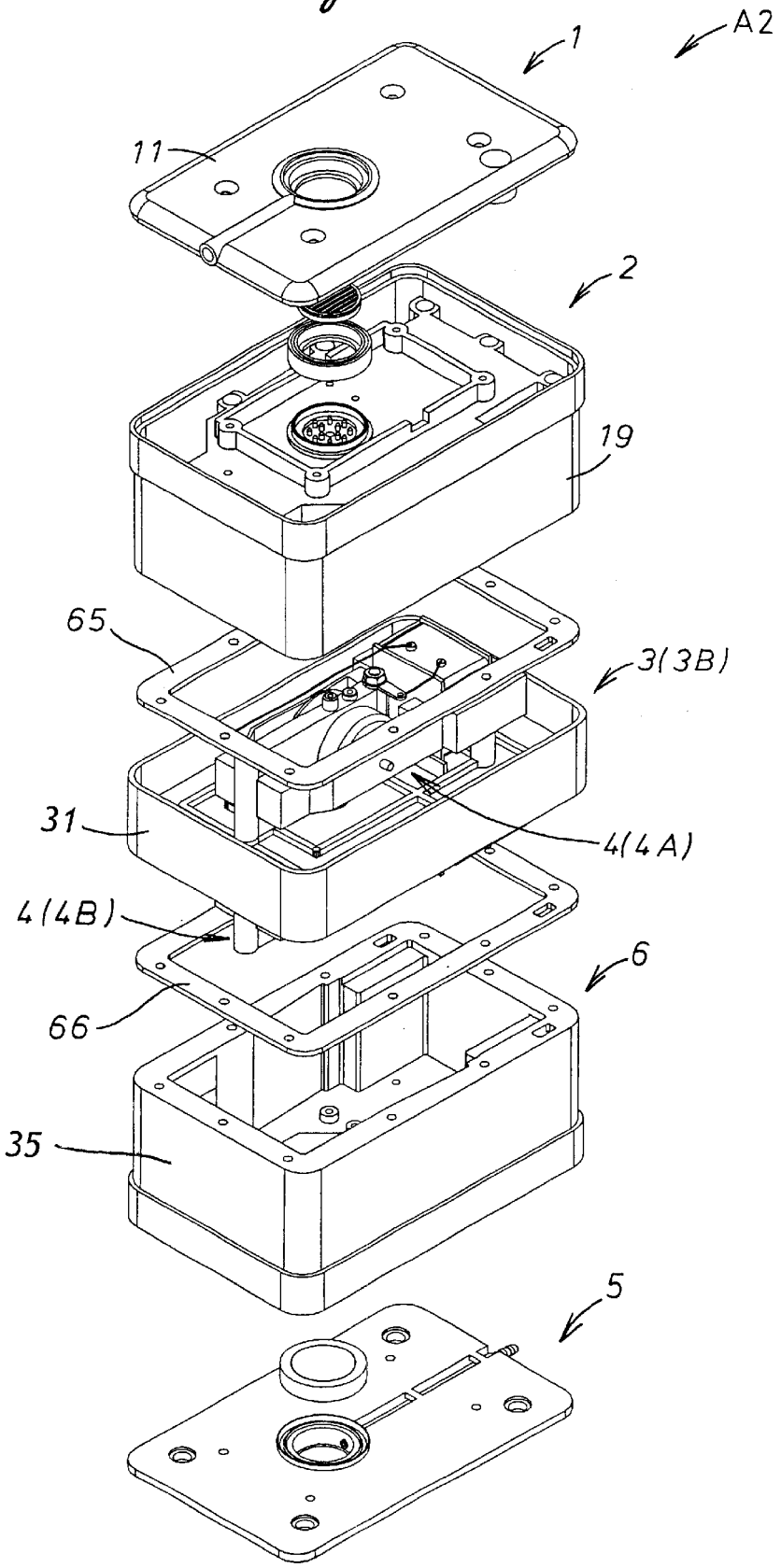
FIG. 2 is an exploded perspective view for showing a two-unit pump apparatus A2 according to the present invention.
Figure 3:
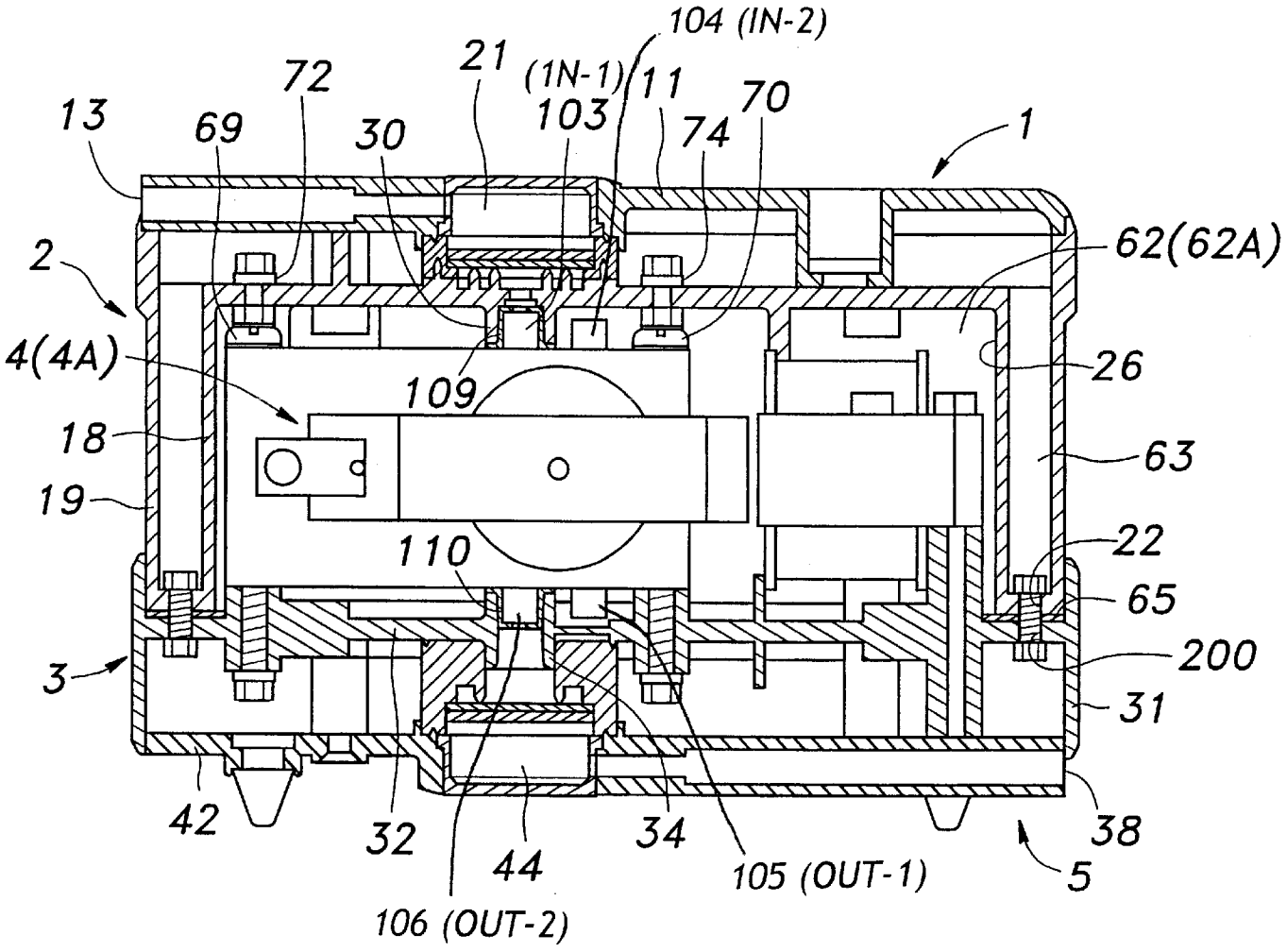
FIG. 3 is a longitudinal sectional view of the one-unit pump apparatus A1 in the assembled state.
Figure 4:
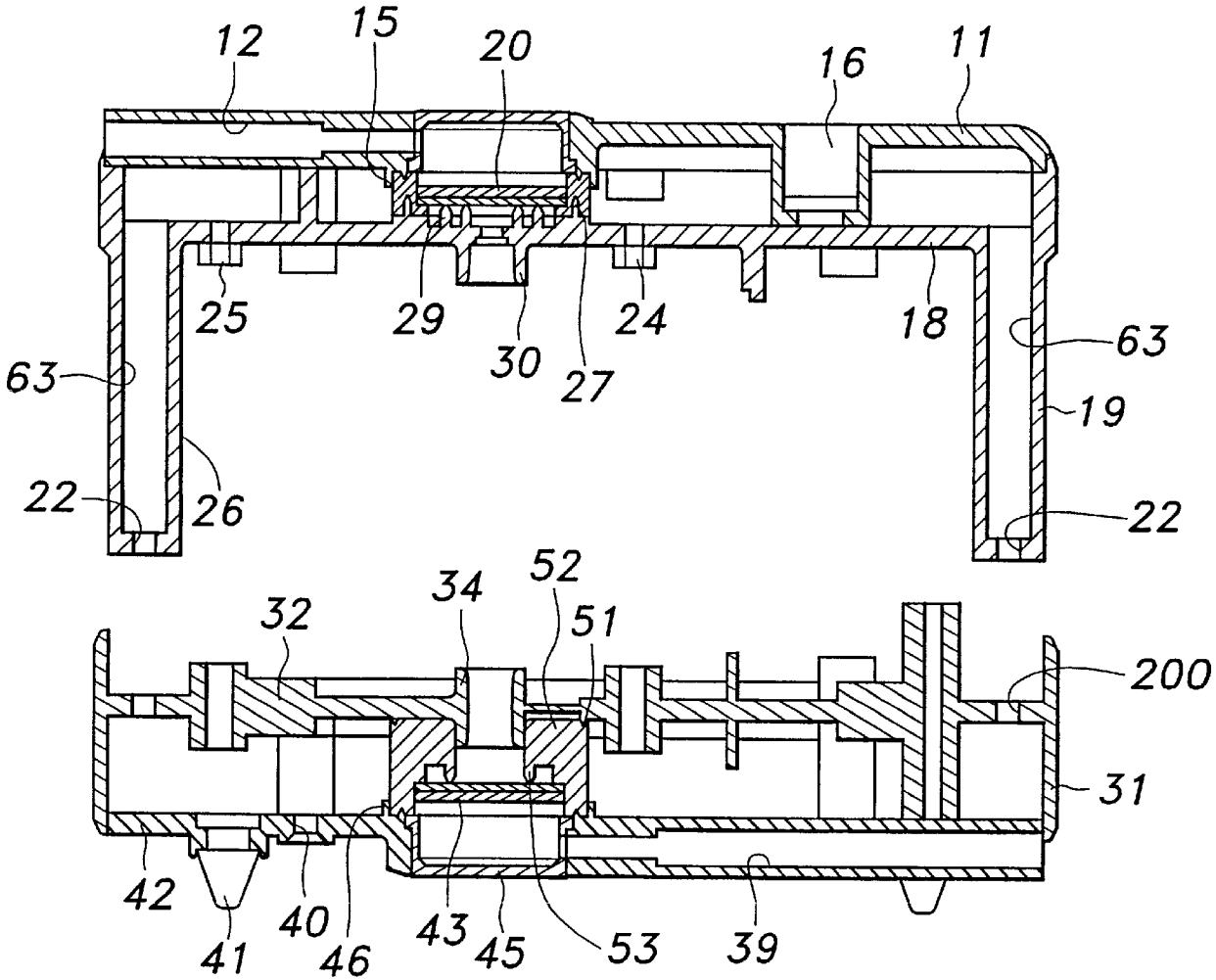
FIG. 4 is a longitudinal sectional view of the one-unit pump apparatus A1 with a pump mechanism 4 (4A) omitted and upper and lower parts separated from each other.
Figure 5:
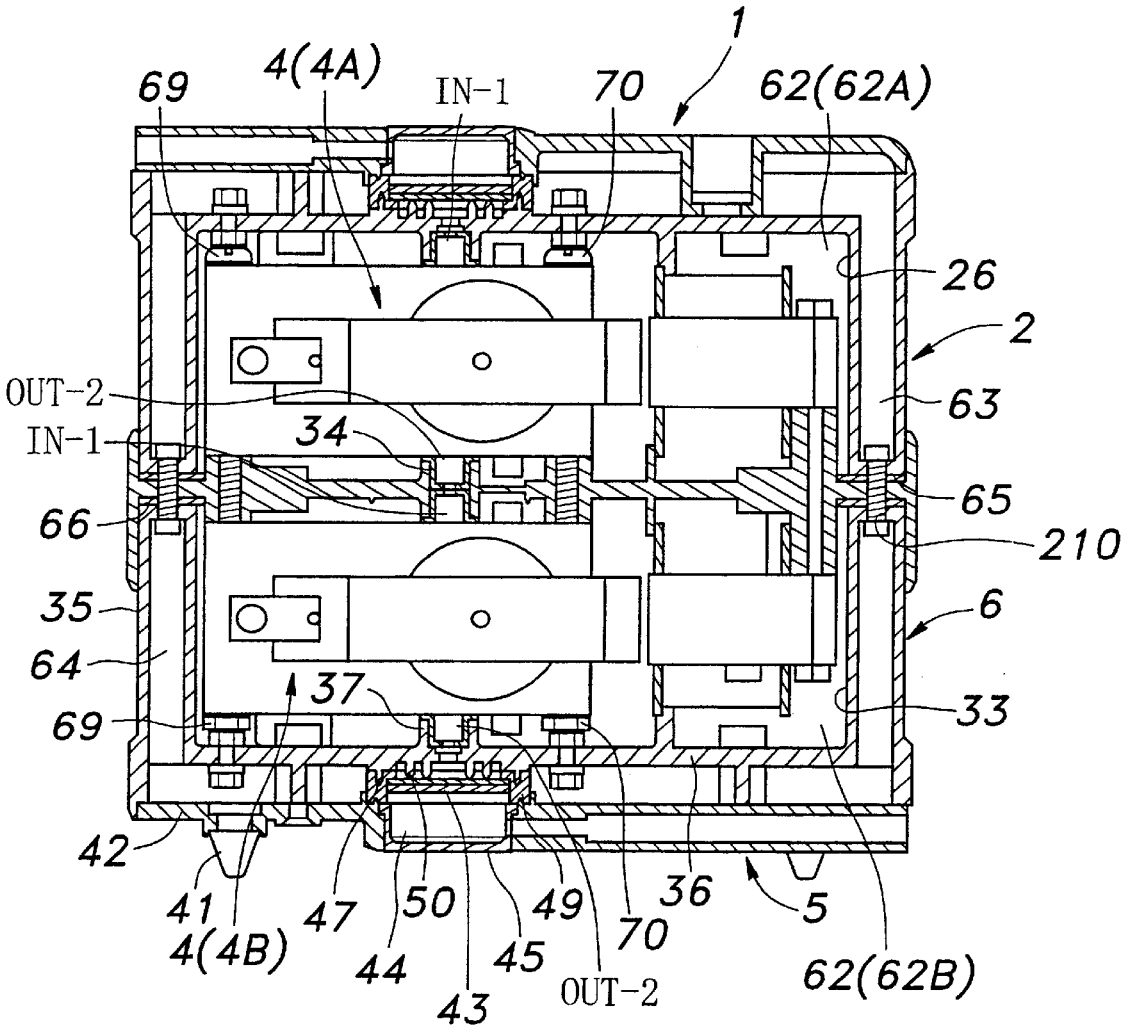
FIG. 5 is a longitudinal sectional view of the two-unit pump apparatus A2 in the assembled state.
Figure 6:
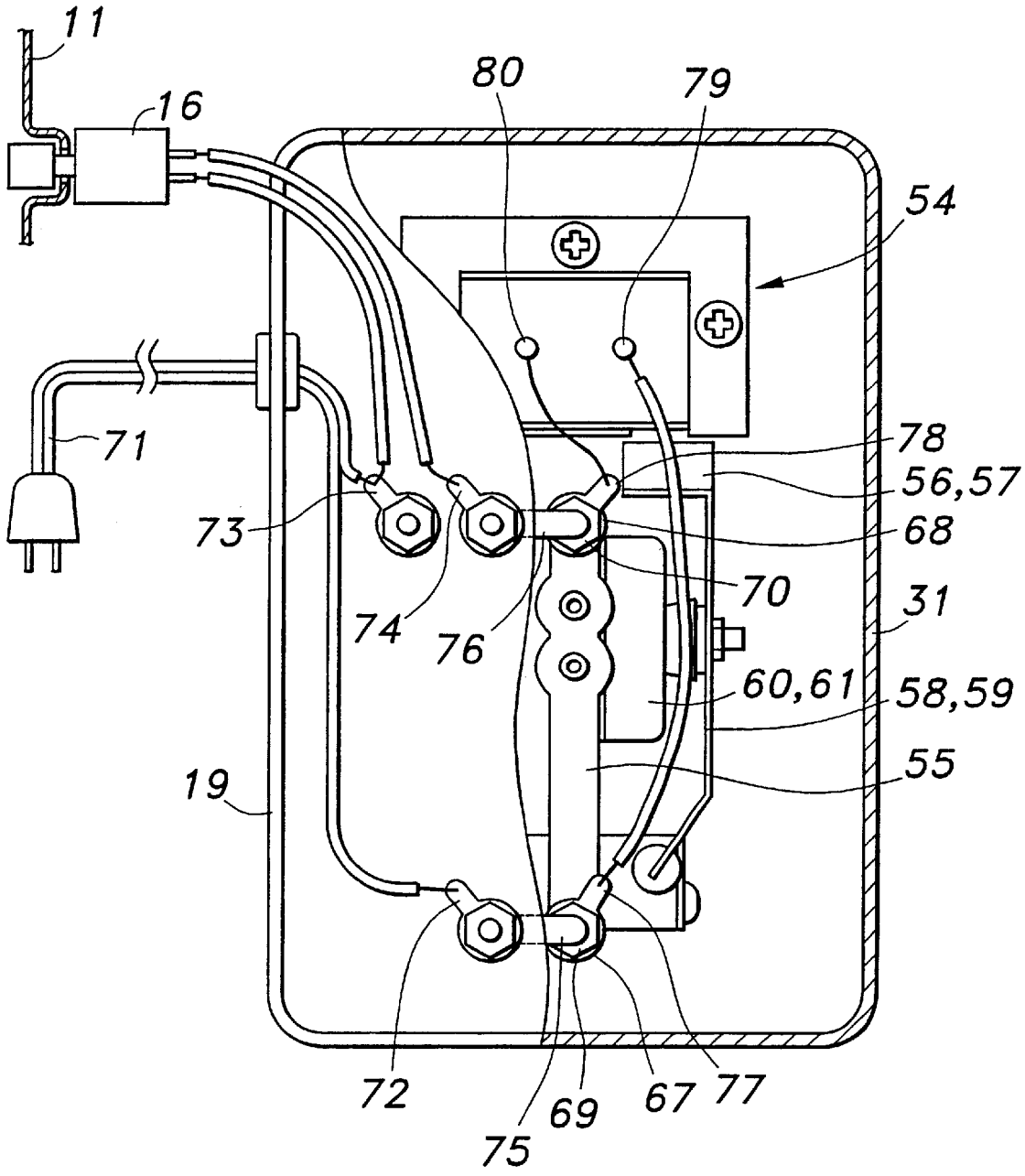
FIG. 6 is a top plan view with part broken for showing electric connection in the pump mechanism.

FIG. 1 is an exploded perspective view for showing a one-unit pump apparatus A1 that is a basic form of an air pump apparatus according to the present invention. FIG. 2 is an exploded perspective view for showing a two unit pump apparatus A2. FIG. 3 is a longitudinal sectional view of the one-unit pump apparatus A1 in the assembled state. FIG. 4 is a longitudinal sectional view of the one-unit pump apparatus A1 with a pump mechanism 4 (4A) omitted and upper and lower parts separated from each other. FIG. 5 is a longitudinal sectional view of the two-unit pump apparatus A2 in the assembled state. FIG. 6 is a top plan view with part broken for showing electric connection for the pump mechanism.

As best seen in FIG. 1, the one-unit pump apparatus A1 comprises, as main part thereof, an upper lid block 1, an upper end case block 2, a pump block 3 including a pump mechanism 4 (4A) attached on an upper side thereof, and a lower lid block 5. As seen in FIG. 2, in addition to the blocks comprised in the one-unit pump apparatus A1, the two-unit pump apparatus A2 further comprises a lower end case block 6 between the pump block 3 (3B) and the lower lid block 5, and two pump mechanisms 4 (4A, 4B) are mounted on upper and under sides of the pump block 3 (3B).

The upper lid block 1 comprises a plate member 11 provided with a horizontally extending air intake passage 12 having one end 13 that is to be connected to an external pipe or the like (when the pump apparatus is used as a discharge pump, however, the one end 13 may be just exposed to atmosphere), a non-lock type power switch 16 to be pushed by the user when starting and stopping operation of the pump apparatus, and a plurality of attachment holes 17. The other end of the air intake passage 12 is connected to an air intake chamber 21 (later described) having an air intake filter 20 therein. A substantially transparent monitoring window 14 for permitting visual inspection of the intake filter 20 is air-tightly fitted in an opening formed on an upper side of the plate member 11 above the air intake filter 20 so as to form an upper wall of the air intake chamber 21. On an underside of the plate member 11 are formed inner and outer annular projections 15 concentrically with the monitoring window 14.

The upper end case block 2 includes an upper end case member 19 that has a generally concave shape. More specifically, the upper end case member 19 includes a partition plate 18 that defines a downwardly facing concave hollow or cavity 26 for accommodating the pump mechanism 4 (4A) therein. In an outer peripheral portion of the upper end case member 19 are provided a plurality of vertically extending cylindrical grooves 63 at the bottom of which are provided attachment holes 22. Joint screws or bolts are passed through the attachment holes 22 in order to join the end case block 2 and the pump block 3 (in the case of two-unit pump apparatus A2, the lower end case block 6 as well (see FIG. 5)). On an upper surface of a horizontally extending portion of the partition plate 18 are formed a set of receptacles 23 aligned with the attachment holes 17 of the plate member 11 to receive screws or the like for joining the upper lid block 1 and the end case block 2. Holes 24 and 25 are also formed in the horizontally extending portion of the partition plate 18 for attaching electric terminal plates for connecting an electric cable introduced through a cable inlet (not shown) to the pump mechanism 4 via the power switch 16, as described more in detail later with reference to FIG. 6.

On the upper side of the horizontally extending portion of the partition plate 18, an annular upward projection 27 is formed to be fitted in an annular groove provided on an underside of a rubber connection ring 28 for holding the above mentioned air intake filter 20 therein. The connection ring 28 is fitted in the outer one of the annular projections 15 provided on the underside of the plate member 11 of the upper lid block 1, and is also provided with an annular groove on its upper side for receiving the inner one of the annular projections 15. Thus in the assembled state, the rubber connection ring 28 is sealingly pressed between the plate member 11 and the partition plate 18 to form the air intake chamber (or suction chamber) 21 containing the air intake filter 20 therein. A plurality of small projections 29 extending upwardly from the upper side of the partition plate 18 function to support the filter 20 with a proper space retained between the filter 20 and the upper surface of the partition plate 18. At a center portion of the annular projection 27, the partition plate 18 has a downwardly extending tubular port 30 defining a through-hole for communicating air from the air intake chamber 21 to the pump block 3 side.

The pump block 3 comprises a pump case member 31 having a generally horizontally extending base plate 32. In the one-unit pump apparatus A1, a single pump mechanism 4 (4A) is attached to an upper surface of the base plate 32 and accommodated in the cavity 26 of the end case block 2, and in the two-unit pump apparatus A2, another pump mechanism 4 (4B) is additionally attached to an under surface of the base plate 32 and accommodated in a cavity 33 defined by a lower end case member 35 of the lower end case block 6. In an outer periphery of the pump case member 31, a plurality of attachment holes 200 are provided in an alignment with the attachment holes 22 of the upper end case member 19. It should be understood that it will be preferable if the components of the pump block 3 can be used commonly in the one-unit and two-unit pump apparatuses (and also in more than two-unit pump apparatuses). In order to achieve this, in the one-unit pump apparatus A1, the under lid block 5 is directly attached to the pump case member 31 of the pump block 3 while in the two-unit pump apparatus A2, the pump case member 31 is attached to the lower end case block 6 which in turn is attached to the under lid block 5. Thus, the pump case member 31 is adapted so as to be attachable to either of the under lid block 5 or the lower end case block 6. Further, it is necessary that the base plate 32 of the pump case member 31 can communicate air from the pump mechanism 4 (4A) to the under lid block 5 in the case of one-unit pump apparatus A1 or to the lower pump mechanism 4 (4B) on the side of the end case block 6 in the case of two-unit pump apparatus A2. For this purpose, the base plate 32 of the pump case member 31 is provided with a tubular port 34 having upwardly and downwardly projecting edges defining a through-hole for communicating air between the upper and lower sides of the base plate 32.

The lower lid block 5 comprises a plate member 42 provided with a horizontally extending discharge passage 39 having one end 38 that is exposed to atmosphere (when the pump apparatus is used as a discharge pump, however, the one end 38 may be connected to an external pipe or the like), a plurality of attachment holes 40 through which attachment screws are passed, and a plurality of rubber feet 41. The other end of the discharge passage 39 is connected to an air discharge chamber 44 (later described) having an air discharge filter 43 therein. A substantially transparent monitoring window 45 for permitting visual inspection of the air discharge filter 43 is air-tightly fitted in an opening formed on an underside of the plate member 42 below the discharge filter 43 so as to form a bottom wall of the discharge chamber 44. On an upper side of the plate member 42 are formed inner and outer annular projections 46 concentrically with the monitoring window 45.

As shown in FIG. 4, the base plate 32 of the pump case member 31 in the pump block 3 is provided with a downwardly extending annular projection 51 concentrically with the air communicating tubular port 34. In the case where the lower lid block 5 is directly attached to the underside of the pump block 3 to form the one-unit pump apparatus A1, a rubber connection ring 52 holding the air discharge filter 43 therein is fitted over the downwardly projecting edge of the tubular port 34. The rubber ring 52 is provided with upper and under annular grooves on its upper and lower sides, respectively, so that the upper and under grooves sealingly engage the downward projection 51 of the base plate 32 of the pump block 3 and the inner one of the upward projections 46 of the plate member 42 of the lower lid block 5, respectively, to thereby form the discharge chamber 44 containing the discharge filter 43 therein. As also seen in FIG. 4, the rubber ring 52 is formed with a plurality of space-retaining downward projections 53 on an inner periphery thereof for supporting the discharge filter 43.

The lower end case block 6 that is added to achieve the two-unit pump apparatus A2 has a substantially mirror image structure of the upper end case block 2. As best shown in FIG. 5, the end case block 6 includes a lower end case member 35 that has a generally concave shape. More specifically, the lower end case member 35 includes an outer sidewall and a partition plate 36 that defines the cavity 33 for accommodating the pump mechanism 4 (4B) therein. Similarly to the upper end case member 19, in an outer peripheral portion of the lower end case member 35 are provided a plurality of vertically extending cylindrical grooves 64 at the bottom of which are provided attachment holes 210 through which joint screws are passed to join the upper end case member 19, pump case member 31 and lower end case member 35 together, to thereby form a pump case assembly defining (two upper and lower) air-tight pump chambers therein. On an underside of a horizontally extending portion of the partition plate 36, an annular downwardly extending projection 47 is formed to be fitted in an annular groove provided on an upper side of a rubber connection ring 49 for holding the above mentioned air discharge filter 43 therein. The connection ring 49 is fitted in the outer one of the annular projections 46 provided on the upper surface of the plate member 42 of the lower lid block 5, and is also provided with an annular groove on its underside for receiving the inner one of the annular projections 46. Thus in the assembled state, the rubber connection ring 49 is sealingly pressed between the plate member 42 and the partition plate 36 to form the discharge chamber 44 containing the discharge filter 43 therein. A plurality of small projections 50 extending downwardly from the underside of the partition plate 36 function to support the filter 43 with a proper space retained between the filter 43 and the under surface of the partition plate 36. At a center portion of the annular projection 47, the partition plate 36 has an upwardly extending tubular port 37 defining a through-hole for communicating air from the upper side of the partition plate 36 (i.e., from the pump mechanism 4 (4B)) to the air discharge chamber 44. It should be noted that the tubular ports 30, 34 and 37of the upper end case block 2, the pump block 3 and the lower end case block 6 respectively are all vertically aligned with each other or in other words they reside on a same vertical axis.

Referring mainly to FIG. 6, the pump mechanism 4 (4A, 4B) comprises a pump main body comprising a base frame 55 and an electromagnetic drive means. The pump main body includes a pair of diaphragms 60, 61 disposed on lateral sides of the base frame 55 to form diaphragm chambers as described more in detail below. The drive means comprises an electromagnet 54 located longitudinally alongside the base frame 55 and a pair of oppositely disposed vibration arms 58, 59 each having one end pivoted to the base frame 55 and other end provided with a permanent magnet 56, 57 so that when an alternating current is supplied to the electromagnet 54, the pair of vibration arms 58, 59 are vibrated symmetrically in accordance with alteration of the magnetic field generated by the electromagnet 54. The pair of diaphragms 60, 61 are attached to a middle portion of the associated vibration arms 58, 59 so that the expansion and compression cycle of the diaphragm chambers is conducted to intake and discharge air according to the movement of the vibration arms 58, 59 driven by the electromagnet 54.

As shown in FIGS. 3 and 5, the pump mechanism 4A is contained in a sealed pump chamber 62 (62A) formed by closing the cavity 26 of the upper end case member 19 of the end case block 2 with the pump case member 31 of the pump block 3, while the pump mechanism 4B is contained in another sealed pump chamber 62 (62B) formed by closing the chamber 33 of the lower end case member 35 of the end case block 6 with the pump case member 31. In order to air-tightly seal the pump chambers 62 (62A, 62B), gasket members 65, 66 each extending along an inner periphery of an outer sidewall of the pump case member 31 of the pump block 3 (best seen in FIG. 2) are interposed between the pump case member 31 and the upper and lower end case members 19, 35, respectively.

The base frame 55 of the pump main body has hollow cylindrical portions 67, 68 (best seen in FIG. 7) at its longitudinal ends for attaching the pump main body to the pump case member 31 by means of joint means 69, 70 each comprising a nut and a long screw passed through an associated one of the vertically extending hollows defined in the cylindrical portions 67, 68. It should be noted that in the two-unit pump apparatus A2, the two pump mechanisms 4A, 4B are secured on the upper and under surfaces of the pump case member 31 by means of commonly used joint means 69, 70. In this way, by forming the joint means 69, 70 of an electrically conductive material, the joint means 69, 70 can also preferably function as means for connecting the power source to the electromagnet 54 in each pump mechanism 4A, 4B, as described below.

Referring to FIG. 6, an electric cord 71 comprising two lines and connected to an AC power source is introduced through a cord inlet to the upper side of the upper end case member 19, and one of the two lines is directed to a connection terminal 72 while the other is directed via a junction terminal 73 to the power switch 16 mounted to the plate member 11 of the upper lid block 1 and then to a connection terminal 74. On the underside of the upper end case member 19 are provided conductive plates 75, 76 made of phosphor bronze or the like with one end thereof being connected to the connection terminals 72, 74, respectively, by means of screws or the like passed through the holes 25, 24 formed in the horizontally extending portion of the partition plate 18 of the upper end case member 19 so that the other end of the conductive plates 75, 76 is placed over the joint means 69, 70, respectively.

The joint means 69, 70 are connected to electric terminals 79, 80 of the electromagnet 54 by means of connection terminals 77, 78 that are mounted together with the joint means 69, 70, respectively, and electric leads. Therefore, when the pump block 3 and the end case block 2 are assembled together, the conductive plates 75, 76 are pressed against the top of the joint means 69, 70 so that the electric paths to the joint means 69, 70, and hence to the terminals 79, 80 of the electromagnet 54 are formed, allowing the electromagnet 54 to be powered by operating the power switch 16. It should be noted that in the case of the two unit pump apparatus A2, not only the electromagnet 54 of the upper pump mechanism 4A but also the electromagnet 54 of the lower pump mechanism 4B may be electrically connected to the joint means 69, 70 by means of suitable connection terminals and electric leads so that the electric power can be supplied to the upper and lower electromagnets 54 simultaneously through the joint means 69, 70.

In this way, electric connection can be achieved easily and conveniently by simply assembling the pump block 3 and the end case blocks 2, 6 together, without requiring additional connectors or the like for that purpose. As an alternative to the above described way of establishing electric paths, however, additional conductive members for electrically connecting the upper and lower pump mechanisms may be provided to the pump case member 31 separately from the joint means 69, 70.

Figure 7:
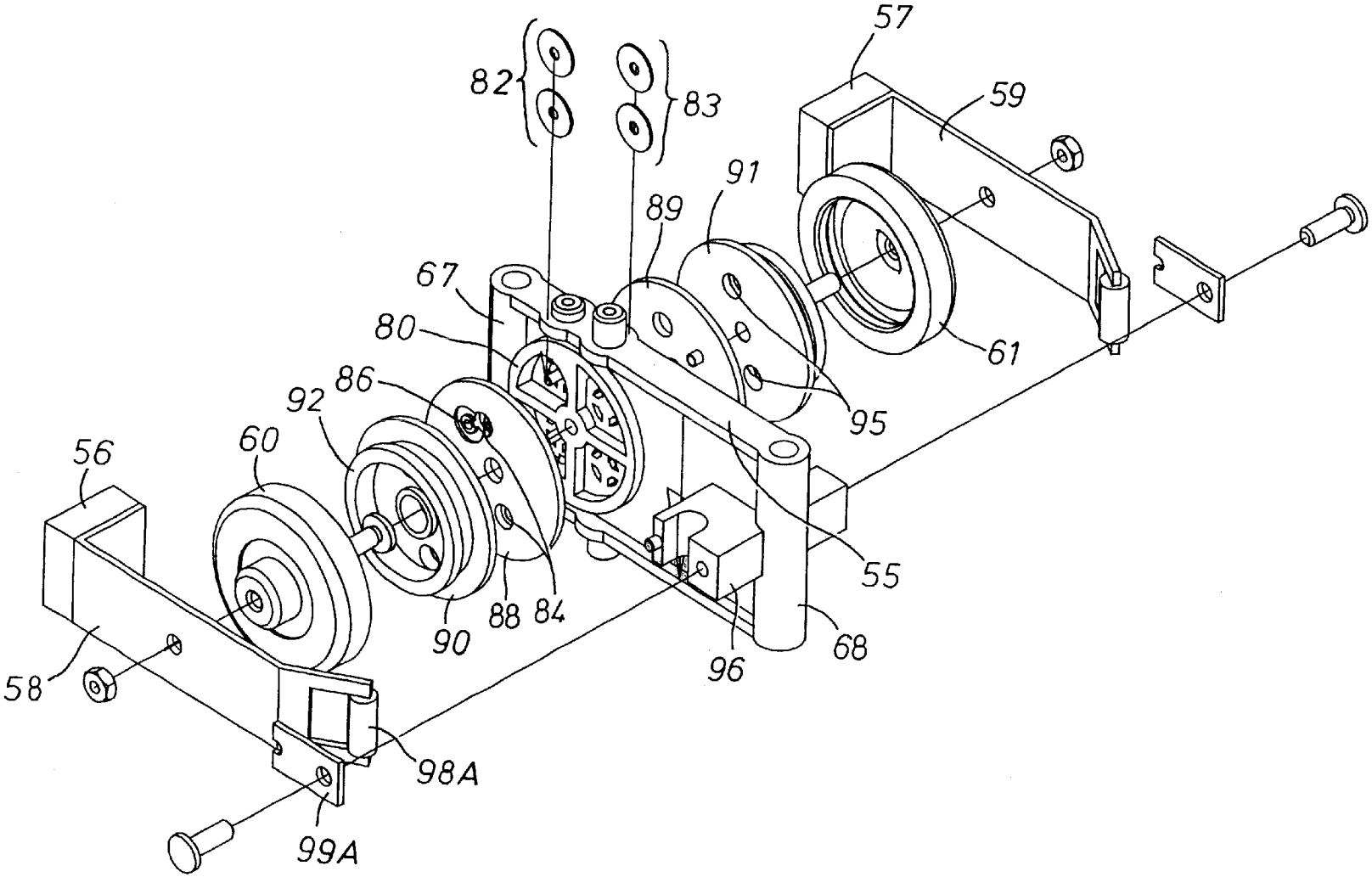
FIG. 7 is an exploded back perspective view of the pump mechanism seen from left side thereof.
Figure 8:
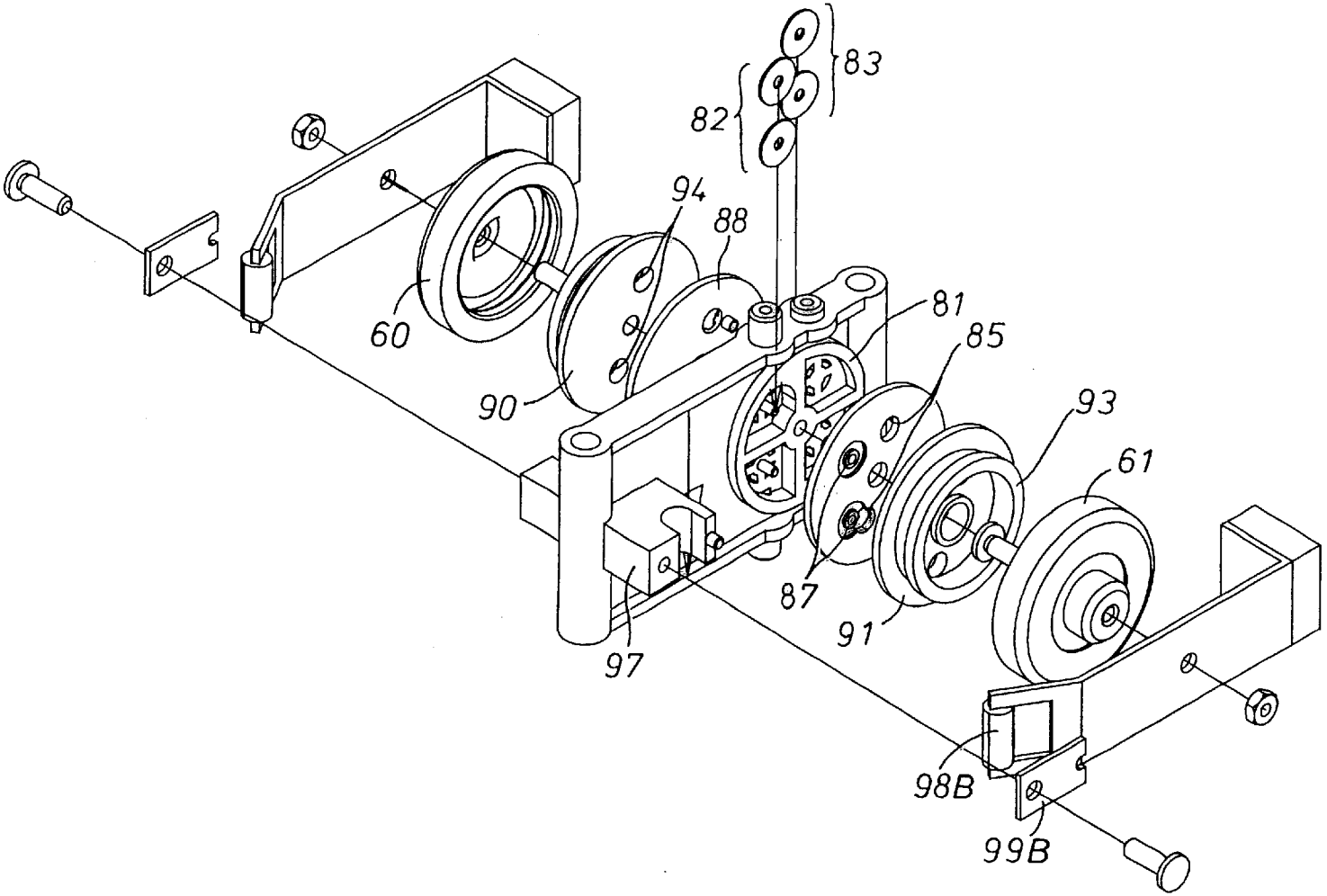
FIG. 8 is an exploded back perspective view of the pump mechanism seen from right side thereof.
Figure 9A:
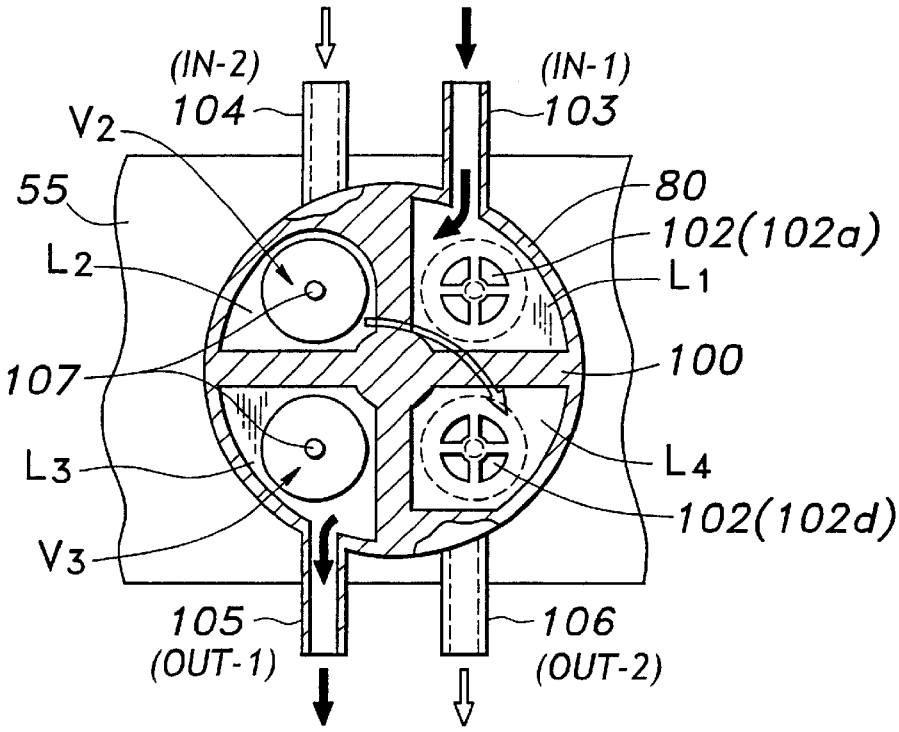
FIGS. 9(*a*) and 9(*b*) are longitudinal partial sectional views for showing the configuration of the diaphragm chambers, FIG. 9(*a*) showing the left side of the base frame 55 while FIG. 9(*b*) showing the right side of the same.
Figure 9B:
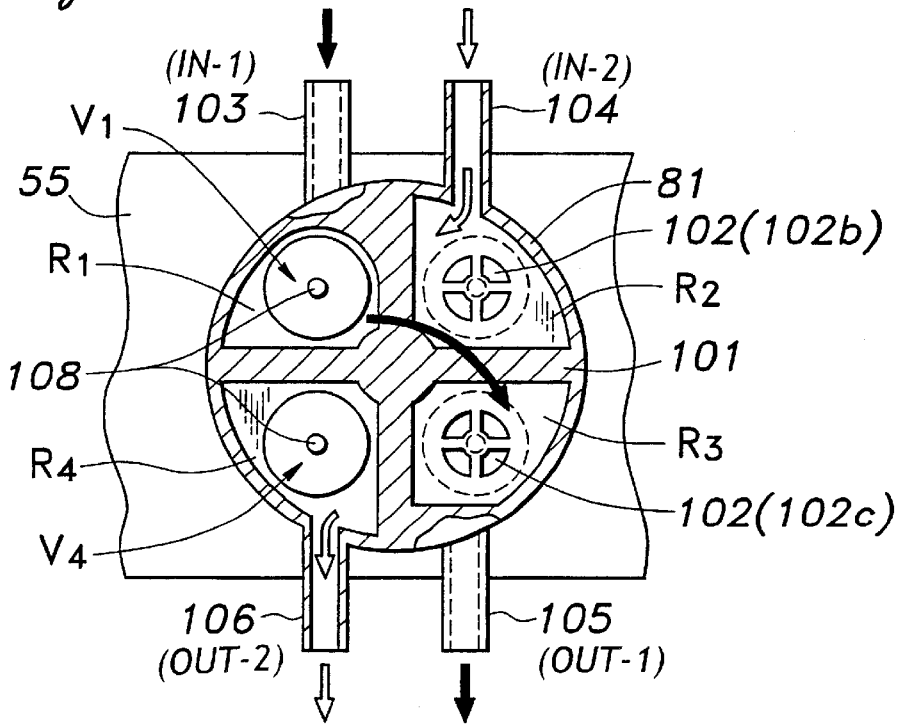
Figure 10:
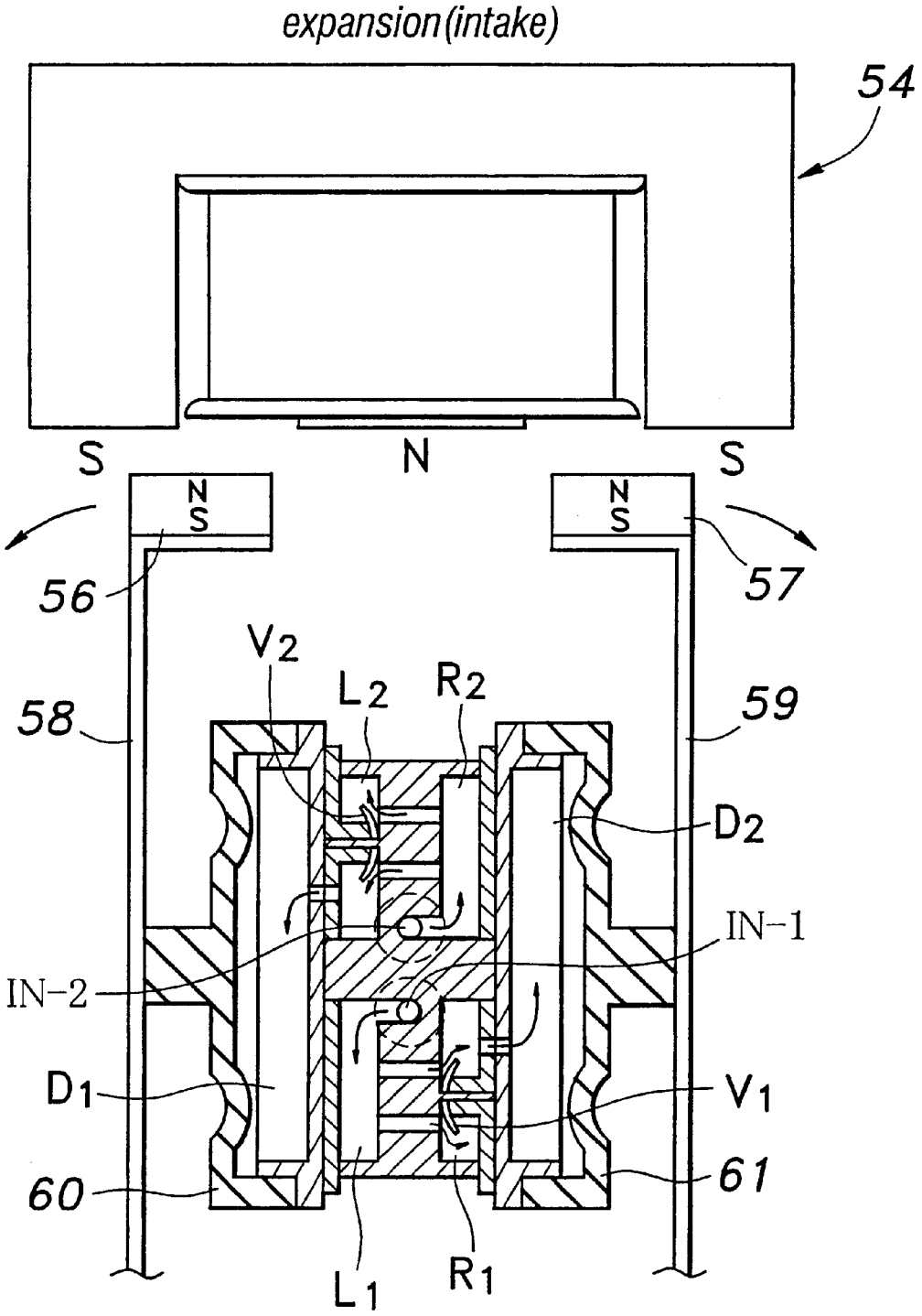
FIG. 10 is a horizontal partial sectional view for showing an intake operation of the diaphragms.
Figure 11:
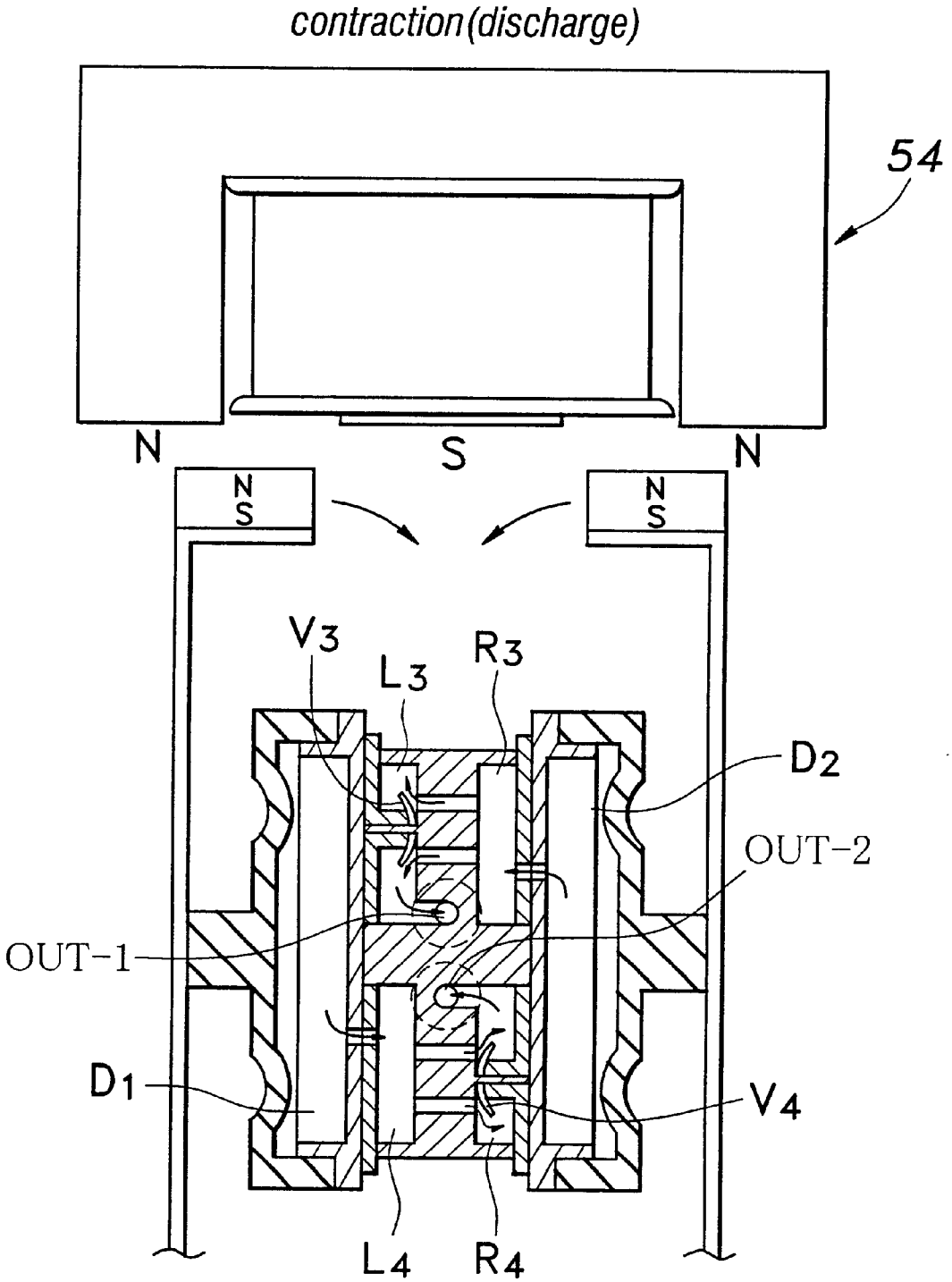
FIG. 11 is a horizontal partial sectional view for showing a discharge operation of the diaphragms.
Figure 12A:
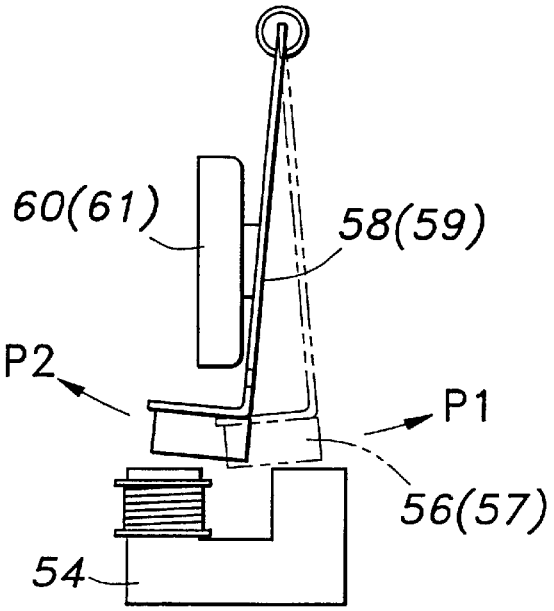
FIGS. 12(*a*)–(*d*) schematically show a load compensation means for the diaphragms.
Figure 12B:
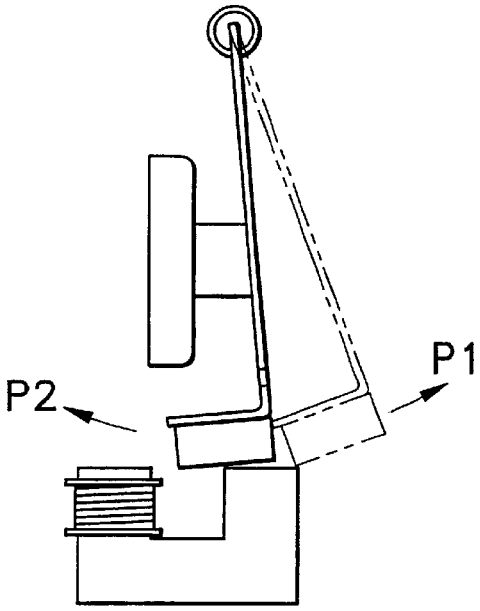
Figure 12C:
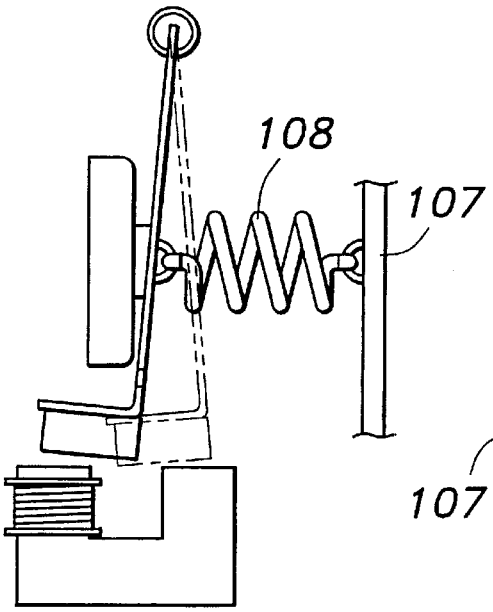
Figure 12D:
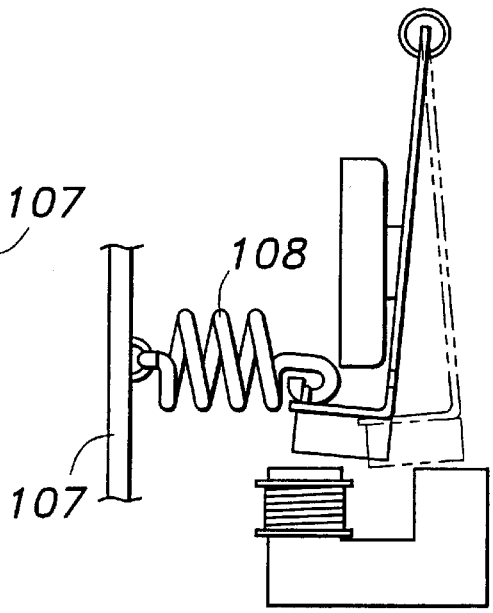

Now, the pump mechanism 4 (4A, 4B) is explained more in detail with reference to FIGS. 7–12 in that FIG. 7 is an exploded back perspective view of the pump mechanism seen from left side thereof; FIG. 8 is an exploded back perspective view of the pump mechanism seen from right side thereof; FIGS. 9(*a*) and 9(*b*) are longitudinal (or front-back direction) partial sectional views for showing the configuration of the diaphragm chambers, FIG. 9(*a*) showing the left side of the base frame 55 while FIG. 9(*b*) showing the right side of the same; FIG. 10 is a horizontal partial sectional view for showing an intake operation of the diaphragms; FIG. 11 is a horizontal partial sectional view for showing a discharge operation of the diaphragms; and FIGS. 12 (*a*)–(*d*) schematically show a load compensation means for the diaphragms.

Referring mainly to FIGS. 7 and 8, the base frame 55 in the pump mechanism 4 (4A, 4B) has partition structures 80, 81 on its lateral sides. Each of the partition structures 80, 81 comprises partition walls (or ridges) defining four valve chambers (L1–L4, R1–R4) arranged in a quadrantal pattern. As explained more in detail later, two (L2, L3) of the four valve chambers defined by the partition structure 80 are provided with flexible disk-shaped valve bodies 82 for selectively opening/closing valve openings formed in a bottom of the two valve chambers L2, L3. Similarly, two (R1, R4) of the four valve chambers defined by another partition structure 81 are provided with flexible disk-shaped valve bodies 83. Opening sides of the partition structures 80, 81 are covered by respective gasket members 88, 89. The gasket member 88 covering the partition structure 80 has two diagonally disposed through-holes 84 at the position corresponding to the valve chambers L2, L4 and is provided with valve-body retaining protrusions 86 to pressingly retain the valve bodies 82 contained in the valve chambers L2, L3. Similarly, the gasket member 89 covering the partition structure 81 has two diagonally disposed through-holes 85 at the position corresponding to the valve chambers R1, R3 and is provided with valve-body retaining protrusions 87 to pressingly retain the valve bodies 83 contained in the valve chambers R1, R4. The gasket members 88, 89 are held between the partition structure 80, 81 and a pair of pump bodies 90, 91 that are attached to the base frame 55 by screw means.

The pump bodies 90, 91 are formed with through-holes 94, 95 that are aligned with the through-holes 84, 85 of the gasket members 88, 89, respectively. Further the pump bodies 90, 91 are provided with cylindrical walls 92, 93, respectively, that extend perpendicularly to the lateral surfaces of the base frame 55. The diaphragms 60, 61 are mounted over the pump main bodies 90, 91, respectively, to thereby form the diaphragm chambers. The vibration arms 58, 59 supporting the diaphragms 60, 61 at the middle portion thereof are hinged to the base frame 55 so that they can swing around the respective vertical axis. More specifically, the vibration arms 58, 59 have rotateable elastic rods 98A, 98B at their one end that are received by corresponding arcuate grooves of support blocks 96, 97 secured to the base frame 55 and are retained in the grooves by means of support plates 99A, 99B screwed to the support blocks 96, 97, respectively.

Referring mainly to FIGS. 9(*a*) and (*b*), the partition structures 80, 81 provided on the lateral sides of the base frame 55 in a back-to-back relation have cross-shaped walls 100, 101 extending perpendicularly to the lateral surfaces of the base frame 55 to define quadrantally arranged four valve chambers within each partition structure 80, 81. Specifically, the partition structure 80 contains left-side valve chambers L1–L4 (in FIG. 9(*a*), the valve chambers are denoted counter-clockwise starting the upper right chamber), while the partition structure 81 contains right-side valve chambers R1-R4 (in FIG. 9(*b*), the valve chambers are denoted clockwise starting the upper left chamber). As shown in FIGS. 9(*a*) and (*b*), two corresponding (or back-to-back) left-side and right-side valve chambers are connected to each other via respective valve openings 102 (102*a*, 102*b*, 102*c*, 102*d*) each consisting of four petal-like openings formed in the bottom of the valve chambers.

The base frame 55 comprises a first air inlet pipe 103 constituting a first inlet port IN-1 and a second air inlet pipe 104 constituting a second inlet port IN-2 on its upper end and a first air outlet pipe 105 constituting a first outlet port OUT-1 and a second air outlet pipe 106 constituting a second outlet port OUT-2 on its under end in a manner that the first air inlet pipe 103 and the second air outlet pipe 106 are aligned on a same axis and the second air inlet pipe 104 and the first air outlet pipe 105 are aligned on a same axis. As shown, the first air inlet pipe 103 is connected to the valve chamber L1, the second air inlet pipe 104 is connected to the valve chamber R2, the first air outlet pipe 105 is connected to the valve chamber L3 and the second air outlet pipe 106 is connected to the valve chamber R4.

The two flexible disk-shaped valve bodies 82 are disposed in the valve chambers L2, L3 with support pins 107 provided at the center of the valve chambers L2, L3 being passed through center holes of the flexible disk-shaped valve bodies 82. Similarly, the two flexible disk-shaped valve bodies 83 are disposed in the valve chambers R1, R4 with support pins 108 provided at the center of the valve chambers R1, R4 being passed through center holes of the flexible disk-shaped valve bodies 83. The valve body retaining protrusions 86, 87 formed in the gasket members 88, 89 are aligned with the support pins 107, 108 so that the support pins 107, 108 can pass through center holes formed in the valve body retaining protrusions 86, 87. In this way, in the assembled state, the valve body retaining protrusions 86, 87 retain the flexible disk-shaped valve bodies 82, 83 by pressing the inner peripheral portions of the disk-shaped valve bodies 82, 83 around the center holes so that the valve bodies 82, 83 can be deformed to selectively open/close the valve openings 102 (see also FIGS. 10 and 11). Thus, the valve opening 102*a* connecting the valve chambers L1 and R1 and its associated one of the flexible valve bodies 83 retained in the valve chamber R1 constitute a first one-way valve (or check valve) V1 permitting an air flow only from the valve chamber L1 to R1 In the similar fashion, a second check valve V2 permitting an air flow only from the valve chamber R2 to the valve chamber L2 is constituted in the valve chamber L2, a third check valve V3 permitting an air flow only from the valve chamber R3 to the valve chamber L3 is constituted in the valve chamber L3, and a fourth check valve V4 permitting an air flow only from the valve chamber L4 to the valve chamber R4 is constituted in the valve chamber R4.

As mentioned above, the pump bodies 90, 91 are attached to the opening side of the partition structures 80, 81 with the gasket members 88, 89 interposed therebetween, and the diaphragms 60, 61 slideably engage the cylindrical walls 92, 93 of the diaphragm pump bodies 90, 91 to define the diaphragm chambers. Specifically, a first diaphragm chamber D1 is defined between the pump body 90 and the diaphragm 60 on a left side of the base frame 55 while a second diaphragm chamber D2 is defined between the pump body 91 and the diaphragm 61 on a right side of the base frame 55.

Thus, the diagonally arranged valve chambers L2 and L4 on the partition structure 80 side are in flow communication via the through-holes 84, 84 formed in the gasket member 88, the through-holes 94, 94 formed in the pump body 90 and the diaphragm chamber D1. Similarly, the diagonally arranged valve chambers R1 and R3 on the partition structure 81 side are in flow communication via the through-holes 85, 85 formed in the gasket member 89, the through-holes 95, 95 formed in the pump body 91 and the diaphragm chamber D2.

Referring to FIG. 9, the air entering the valve chamber L1 via the first inlet port IN-1 flows into the valve chamber R1 via the first check valve V1. Then, the air is delivered to the valve chamber R3 via the diaphragm chamber D2 and, via the third check valve V3, enters the valve chamber L3 from which the air is discharged via the first outlet port OUT-1. In this way, a first air flow passage (IN-1→L1→(V1)→R1→D2→R3→(V3)→L3→OUT-1) is formed.

Similarly, the air entering the valve chamber R2 via the second inlet port IN-2 flows into the valve chamber L2 via the second check valve V2. Then, the air is delivered to the valve chamber L4 via the diaphragm chamber D1 and, via the fourth check valve V4, enters the valve chamber R4 from which the air is discharged via the second outlet port OUT-2. In this way, a second air flow passage (IN-2→R2→(V2)→L2→D1→L4→(V4)→R4→OUT-2) is formed.

In the one-unit pump apparatus A1, as seen in FIG. 3, the pump mechanism 4A is mounted between the upper end case member 19 and the pump case member 31, with the first air inlet pipe 103 constituting the first inlet port IN-1 being fitted into the downwardly extending tubular port 30 of the upper end case member 19 so as to be in flow communication with the air intake chamber 21, the first air outlet pipe 105 constituting the first outlet port OUT-1 and the second air inlet pipe 104 constituting the second inlet port IN-2 being in flow communication with (or exposed inside) the pump chamber 62A, and the second air outlet pipe 106 constituting the second outlet port OUT-2 being fitted into the upwardly projecting edge of the tubular port 34 of the base plate 32 of the pump case member 31. The downwardly projecting edge of the tubular port 34 is connected to the discharge chamber 44 so that the second outlet port OUT-2 is in flow communication with the discharge chamber 44 via the air communication port 34.

Thus, in the one-unit pump apparatus A1, the two diaphragm chambers D1, D2 are connected in series via the pump chamber 62A to achieve a high pump performance, and since the two diaphragm chambers D1, D2 are formed on the lateral sides of the base frame 55, the series connection of the two diaphragm chambers is achieved without increasing an axial length of the pump apparatus.

In the two-unit pump apparatus A2, as seen in FIG. 5, the pump mechanism 4A is mounted in the same fashion as in the one-unit pump apparatus A1 but the downwardly projecting edge of the tubular port 34 of the base plate 32 is fittingly connected to the first air inlet pipe 103 of the second pump mechanism 4B that is contained in the pump chamber 62B defined by the pump case member 31 and the lower end case member 35. Thus, the second outlet port OUT-2 of the first pump mechanism 4A is connected to the first inlet port IN-1 of the second pump mechanism 4B via the tubular port 34 of the base plate 32 of the pump case member 31. Further, similarly to the ports of the first pump mechanism 4A, the first air outlet pipe 105 and the second air inlet pipe 104 of the second pump mechanism 4B are in flow communication with the pump chamber 62B. The second air outlet pipe 106 of the second pump mechanism 4B is fitted into the tubular port 37 of the lower end case member 35 which in turn is connected to the discharge chamber 44 so that the second outlet port OUT-2 of the second pump mechanism is in flow communication with the discharge chamber 44.

It should be noted that since the first air flow passage and the second air flow passage cross each other in each pump mechanism 4A, 4B so that the first air inlet pipe 103 and the second air outlet pipe 106 are axially aligned, axial alignment of the first and second pump mechanisms 4A, 4B automatically achieves the axial alignment of the outlet side of the first pump mechanism 4A and the inlet side of the second pump mechanism 4B. This, in cooperation with the joint means 69, 70 used in connecting the power source to the electromagnets 54, 54 in the pump mechanisms 4A, 4B and the base plate 32 adapted to be capable of attaching two pump mechanisms on its upper and under surfaces, considerably facilitates the addition of the second pump mechanism 4B to make the two- unit pump apparatus A2. Further, it should be noted that since the electromagnetic drive means is disposed alongside the pump body, the axial length of each pump mechanism 4A, 4B is relatively small and thus, an increase in the total axial size of the air pump apparatus due to addition of the second pump mechanism 4B is relatively small. It should be also understood that such advantageous features of the present invention are similarly effective in assembling a multi-unit pump apparatus comprising more than two pump mechanisms 4.

Now, referring FIGS. 10 and 11, the operation of the pump mechanism 4 is explained in the following. When the electromagnet 54 preferably having an E-shaped laminated core is energized by 50 Hz or 60 Hz (or any other commercial power frequency) alternating current electric power, the electromagnet 54 accordingly produces a magnetic field with an alternating magnetic force direction. Thus, at one time, the laminated core of the electromagnet 54 has an S-N-S magnetic pole arrangement as shown in FIG. 10, and at another time it has an N-S-N magnetic pole arrangement as shown in FIG. 11. In the shown embodiment, each of the permanent magnets 56, 57 attached to the free end of the vibration arms 58, 59 has an N pole on the side facing the electromagnet 54. Therefore, in the state shown in FIG. 10, the vibration arms 58, 59 are moved generally outwardly away from each other and the diaphragms 60, 61 are accordingly moved in the direction for expanding the volume of the diaphragm chambers Di, D2 to effect an air intake process. On the other hand, in the state shown in FIG. 11, the vibration arms 58, 59 are moved generally inwardly toward each other and the diaphragms 60, 61 are accordingly moved in the direction for reducing the volume of the diaphragm chambers D1, D2 to effect an air discharge process.

During the air intake process, as seen in FIG. 10, a pressure reduction in the diaphragm chamber D2 due to the expansion thereof causes air to flow into the diaphragm chamber D2 from the first inlet port IN-1 via the first check valve V1 and through-holes 85, 95, and at the same time, a pressure reduction in the diaphragm chamber D1 due to the expansion thereof causes air to enter the diaphragm chamber D1 from the second inlet port IN-2 via the second check valve V2 and through-holes 84, 94. During the air intake process, the third check valve V3 and the fourth check valve V4 are closed so that a reverse air entrance to the diaphragm chambers D1, D2 through the second and first air outlet ports OUT-2, OUT-1, respectively, is prevented.

During the air discharge process, as seen in FIG. 11, a pressure increase in the diaphragm chamber D2 due to the contraction thereof causes air to flow to the first outlet port OUT-1 via the through-holes 85, 95 and the third check valve V3, and at the same time, a pressure increase in the diaphragm chamber D1 due to the contraction thereof causes air to flow to the second outlet port OUT-2 via the through-holes 84, 94 and the fourth check valve V4. During the air discharge process, the first check valve V1 and the second check valve V2 are closed so that air is prevented from being reversely discharged from the diaphragm chambers D1, D2 through the second and first air inlets IN-2, IN-1, respectively.

In the case where a load (for example, an aquarium, tire or balloon) is connected to the outlet side of the air pump apparatus, as the air intake and discharge processes are repeated alternatingly, the pressure in the pump chamber 62, to which the first outlet port OUT-1 is opened, is increased until it reaches a constant high value. The pressurized air in the pump chamber 62 flows through the second inlet port IN-2, which is also opened to the pump chamber 62, into the pump mechanism 4 and is further pressurized by the same and discharged through the second outlet port OUT-2. Therefore, the discharge pressure at the second outlet port OUT-2 can be increased than that at the first outlet port OUT-1. Similarly, in the case where a load is connected to the inlet side of the air pump apparatus (such as when a semiconductor wafer to be picked up closes the inlet side of the pump apparatus), the suction force at the first inlet port IN-1 can be greater than that at the second inlet port IN-2. Thus, even a single pump unit constituted by a single pump mechanism 4 and its associated pump chamber 62 can exhibit a high pump capacity due to the series-connected two diaphragm chambers.

In the two-unit pump apparatus A2 comprising two series-connected pump mechanisms 4A, 4B, the pump capacity can be increased two times with respect to the one-unit pump apparatus A1 and the pump capacity will be increased even further in the three-unit pump apparatus. Thus, by connecting a suction nozzle to the opening 13 of the air intake passage 12 of the upper lid block 1 that is connected to the first inlet port IN-1 of the first (or uppermost) pump mechanism 4 via the air intake chamber 21, a compact but high-power suction pump apparatus for picking up a semiconductor wafer or the like by suction vacuum can be achieved easily and at low cost.

Similarly, by connecting a discharge nozzle to the opening 38 of the discharge passage 39 of the lower lid block 5 connected to the discharge chamber 44 that is connected to the second outlet port OUT-2 of the lowermost pump mechanism 4, a compact, high-power discharge pump apparatus can be achieved easily and at low cost.

Referring to FIG. 12, in the operation of the pump mechanism 4, as the pressure difference between the inside and outside of the diaphragm chambers D1, D2 increases, the moveable range of the vibration arms 58, 59 may undesirably shift from a normal position (i.e., a condition in that the vibration arm 58 (59) swings evenly in an outward direction (P1) and inward direction (P2) with respect to a neutral position as shown in FIG. 12(*a*)) to an outwardly offset one (shown in FIG. 12(*b*)) or inwardly offset one (not shown).

Once such an offset of the moveable range of the vibration arms 58, 59 occurs, the position of the permanent magnets 56, 57 attached to the ends of the vibration arms 58, 59 with respect to the electromagnet 54 is also changed from an optimum position for efficiently driving the diaphragms 60, 61 to expand and contract the diaphragm chambers, leading to a lower pump performance. Moreover, if the pump mechanism is operated in such an offset state for an extended period of time, an excessive heat may be generated to undesirably soften or deform the diaphragms 60, 61.

Thus, in order to control the moveable range of the diaphragms 58, 59 to thereby prevent the diaphragms 58, 59 from moving beyond an optimum range, a coil spring 108 may be connected between an engagement plate 107 provided to the base plate 32 and the outer side of the vibration arm 58 (59) as shown in FIG. 12(*c*), in which the coil spring 108 is adapted to control the inward shift of the moveable range of the vibration arm 58 (59) for example. In this way, the coil spring 108 can function as offset controlling means, allowing the pump apparatus to exhibit a high performance for an extended period of time.

The coil spring 108 may be connected between the engagement plate 107 provided to the base plate 32 and the inner side of the vibration arm 58 (59) as shown in FIG. 12(*d*), in which the coil spring 108 functions to control the outward shift of the moveable range of the vibration arm 58 (59).

Figure 13:
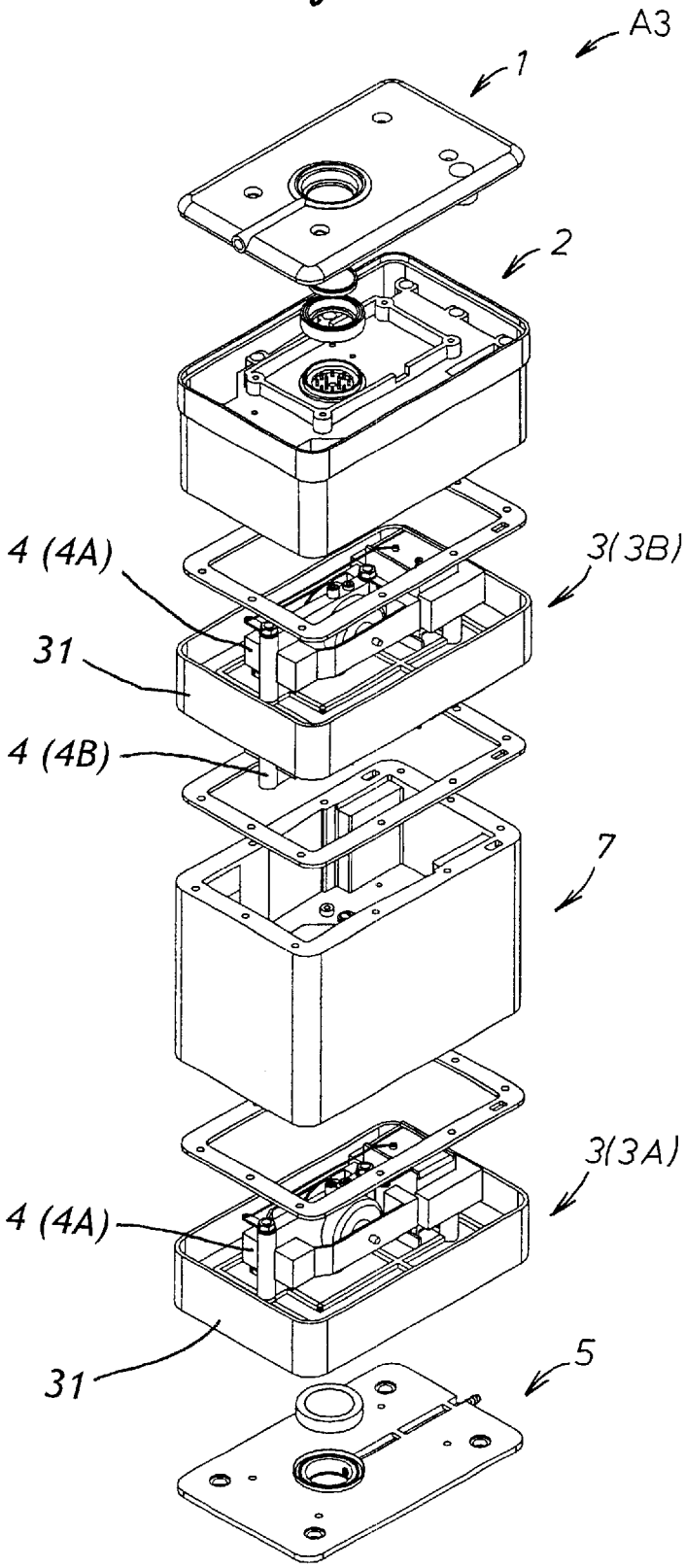
FIG. 13 is an exploded perspective view for showing a three-unit pump apparatus A3 according to the invention.

In the following, a multi-unit pump apparatus comprising more than two pump mechanisms 4 is explained with reference to FIGS. 13 and 14. FIG. 13 shows a three-unit pump apparatus A3 that comprises, as main part thereof, an upper lid block 1, an upper end case block 2 for accommodating a pump mechanism 4 (4A) on its underside, a pump block 3 (3B) having two pump mechanisms 4 (4A, 4B) attached on upper and under sides thereof, an intermediate case block 7 for accommodating the pump mechanism 4 (4B) on its upper side and accommodating an additional pump mechanism 4 (4A) on its underside, another pump block 3 (3A) having the additional pump mechanism 4 (4A) attached on its upper side, and a lower lid block 5.

Thus, in the three-unit pump apparatus A3, both of the pump block 3 (3A) used in the one-unit pump apparatus A1 for supporting a single pump mechanism 4 (4A) on its upper side and the pump block 3 (3B) used in the two-unit pump apparatus A2 for supporting two pump mechanisms 4 (4A, 4B) on its upper and under sides are used. Further, instead of the lower end case block 6 in the two-unit pump apparatus A2, the intermediate case block 7 is used for accommodating two pump mechanisms 4 on its upper and lower sides.

The intermediate case block 7 defines two concave hollows on its upper and lower sides, each being the same as defined in the upper side of the lower end case block 6, and accordingly the intermediate case block 7 has a symmetrical shape in the up-down direction. Thus, the concave hollow on the underside of the intermediate case block 7 can provide a space for accommodating the pump mechanism 4 (4A) of the lower pump block 3 (3A). It should be noted that except for the intermediate case block 7 and the additional (lower) pump block 3 (3A), the three-unit pump apparatus A3 has the same structure as the two-unit pump apparatus A2.

Figure 14:
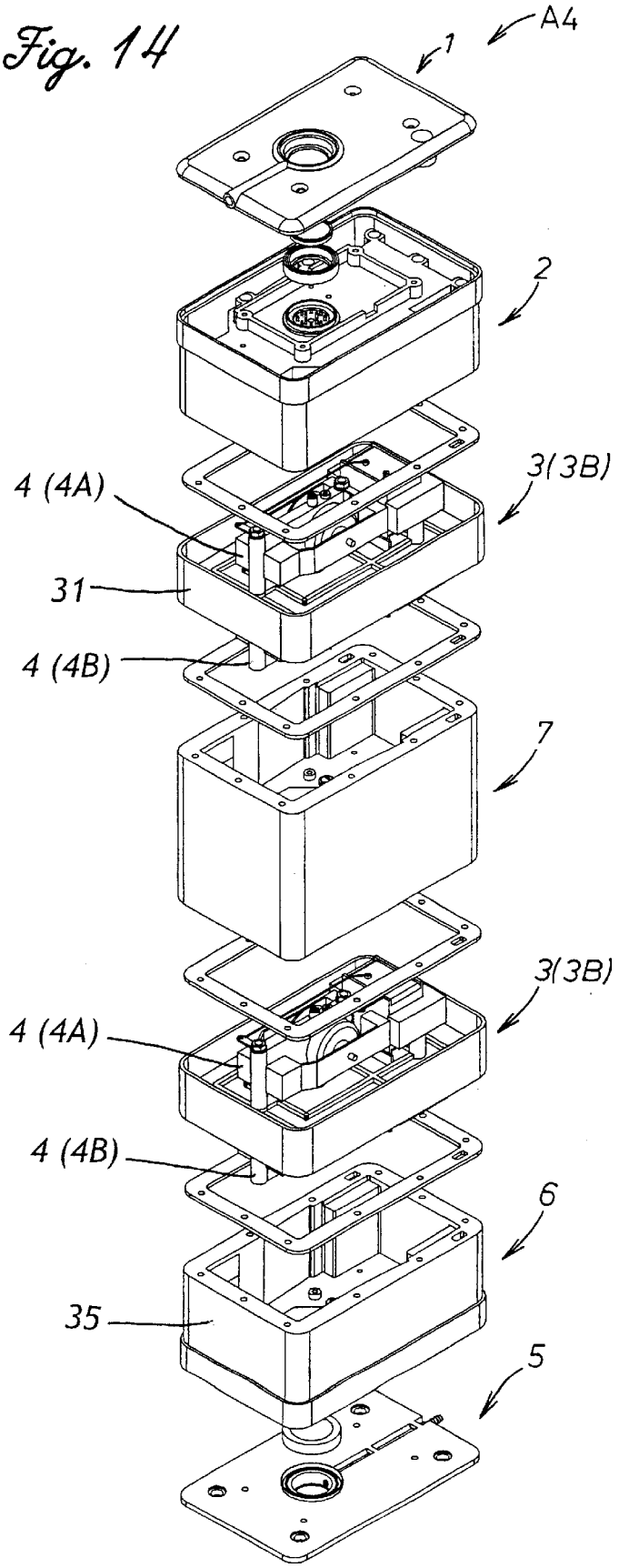
FIG. 14 is an exploded perspective view for showing a four-unit pump apparatus A4 according to the invention.

FIG. 14 shows a four-unit pump apparatus A4 that comprises, as main part thereof, an upper lid block 1, an upper end case block 2 for accommodating a pump mechanism 4 (4A) on its underside, a pump block 3 (3B) having two pump mechanisms 4 (4A, 4B) attached to upper and under sides thereof, an intermediate case block 7 for accommodating the pump mechanism 4 (4B) on its upper side and accommodating an additional pump mechanism 4 (4A) on its underside, another pump block 3 (3B) having two pump mechanisms 4 (4A, 4B) attached on its upper and under sides, a lower end case block 6 for accommodating the pump mechanism 4 (4B) on its upper side, and a lower lid block 5.

Thus, the four-unit pump apparatus A4 comprises two pump blocks 3 (3B) as used in the two-unit pump apparatus A2 each supporting two pump mechanisms 4 (4A, 4B) on the upper and under sides. Further, the intermediate case block 7 as used in the three-unit pump apparatus A3 is interposed between the two pump blocks 3 (3B).

In this way, multi-unit pump apparatuses comprising more than two pump mechanisms can be achieved by using the component parts identical to those used in the one-unit or two-unit pump apparatuses A1, A2 except for the intermediate case block 7. This makes it possible to readily increase or decrease the number of pump mechanisms 4 included in a pump apparatus and thus change the pump capacity easily and at low cost.

Although the present invention has been described in terms of concrete embodiments thereof, it is obvious to a person skilled in the art that various alterations and modifications are possible without departing from the scope of the present invention which is set forth in the appended claims. For example, the above explained pump apparatus can be used not only as a suction pump but also as a discharge pump. Further, although the shown embodiments included the upper and lower lid blocks 1, 5 to incorporate the intake and discharge filters and/or to position the air inlet and outlet on the side of the pump apparatus, both or either of them may be omitted in some embodiments of the present invention.

Further, in the two-unit pump apparatus A2 for instance, it may be possible to provide an upwardly extending tubular port on the upper side of the upper end case member 19 with the upwardly extending tubular port being axially aligned with the downwardly extending tubular port 30, into which the first air inlet pipe 103 of the pump mechanism 4 is fitted, so that the upwardly extending tubular port can be connected to a suction nozzle or the like via an external pipe means containing a filter therein. It could be also possible to provide a downwardly extending tubular port on the underside of the lower end case member 35 with the downwardly extending tubular port being axially aligned with the upwardly extending tubular port 37, into which the second air outlet pipe 106 of the pump mechanism 4 is fitted, so that the underside tubular port can hold a discharge filter therein.

In order to ensure that each pump chamber 62 is sealed air-tightly, annular gasket members (109, 110 in FIG. 3) may be provided to surround the first air inlet pipe 103 and the second air outlet pipe 106 of each pump mechanism 4 so that the annular gasket members 109, 110 prevent air from leaking through a space between the ports 103, 106 and the tubular ports into which they are fitted. Similar gasket members may be provided at other portions where air leak from or into the pump chamber 62 may take place.

What is claimed is:

1. An air pump apparatus, comprising:

a first pump mechanism; and a pump case assembly forming a first air-tight pump chamber in that the first pump mechanism is contained, wherein the first pump mechanism comprises:

a base frame having a first end and a second end opposite to the first end, the first and second ends of the base frame defining an axial direction of the air pump apparatus;

mutually opposing first and second diaphragms defining first and second diaphragm chambers on lateral sides of the base frame respectively;

electromagnetic drive means for driving the first and second diaphragms so as to expand and contract the first and second diaphragm chambers;

a first inlet port defined in the first end of the base frame for communicating air into the first diaphragm chamber upon expansion of the first diaphragm chamber, with a first one-way valve being provided between the first inlet port and the first diaphragm chamber for permitting air flow only into the first diaphragm chamber;

a second inlet port defined in the base frame for communicating air into the second diaphragm chamber upon expansion of the second diaphragm chamber, a second one-way valve being provided between the second inlet port and the second diaphragm chamber for permitting air flow only into the second diaphragm chamber;

a first outlet port defined in the base frame for discharging air from the first diaphragm chamber upon contraction of the first diaphragm chamber, a third one-way valve being provided between the first outlet port and the first diaphragm chamber for permitting air flow only out of the first diaphragm chamber; and a second outlet port defined in the second end of the base frame for discharging air from the second diaphragm chamber upon contraction of the second diaphragm chamber, a fourth one-way valve being provided between the second outlet port and the second diaphragm chamber for permitting air flow only out of the second diaphragm chamber, and the second outlet port being in axial alignment with the first inlet port, and wherein the first inlet port and the second outlet port of the first pump mechanism are in flow communication with outside of the first pump chamber, and the first outlet port and the second inlet port of the first pump mechanism are in flow communication with the first pump chamber.

2. An air pump apparatus according to claim 1, wherein the pump case assembly comprises:

a first case member including a base plate extending generally perpendicularly to the axial direction, the base plate having: a first surface on which the first pump mechanism is attached; a second surface opposite to the first surface; and a through-hole extending through the base plate at a position axially aligned with the first inlet port and the second outlet port of the first pump mechanism; and a second case member attached to the first case member so as to form the first air-tight pump chamber, the second case member being provided with a through-hole at a position axially aligned with the first inlet port and the second outlet port of the first pump mechanism, wherein the first inlet port of the first pump mechanism is in flow communication with outside of the first pump chamber via one of the through-holes provided to the base plate of the first case member and the second case member, and the second outlet port of the first pump mechanism is in flow communication with outside of the first pump chamber via the other of the through-holes provided to the base plate of the first case member and the second case member.

3. An air pump apparatus according to claim 2, wherein the first inlet port of the first pump mechanism is connected to the through-hole provided to the second case member, and the second outlet port of the first pump mechanism is connected to the through-hole provided to the base plate of the first case member.

4. An air pump apparatus according to claim 3, wherein the second surface of the base plate of the first case member is adapted so as to be capable of attaching thereto another pump mechanism having an identical configuration to the first pump mechanism with a first inlet port of the another pump mechanism being connected to the through-hole of the base plate of the first case member so that when the another pump mechanism is attached to the second surface of the base plate of the first case member, the second outlet port of the first pump mechanism and the first inlet port of the another pump mechanism are in flow communication via the through-hole of the base plate of the first case member.

5. An air pump apparatus according to claim 4, further comprising:

a second pump mechanism having an identical configuration to the first pump mechanism and attached to the second surface of the base plate of the first case member with a first inlet port of the second pump mechanism being connected to the through-hole of the base plate of the first case member.

6. An air pump apparatus according to claim 5, wherein the pump case assembly further comprises a third case member attached to the first case member so as to form a second air-tight pump chamber for containing the second pump mechanism therein, the third case member being provided with a through-hole at a position axially aligned with a second outlet port of the second pump mechanism so that the through-hole is connected to the second outlet port of the second pump mechanism, wherein a first outlet port and a second inlet port of the second pump mechanism are in flow communication with the second pump chamber.

7. An air pump apparatus according to claim 5, further comprising a third pump mechanism having an identical configuration to the first pump mechanism, wherein the pump case assembly further comprises:

a third case member having an identical configuration to the first case member and axially aligned with the same so that a first surface of a base plate of the third case member faces the second surface of the base plate of the first case member, the third pump mechanism being attached to the first surface of the base plate of the third case member with a second outlet port of the third pump mechanism being connected to a through-hole of the base plate of the third case member; and a fourth case member interposed between the first and third case members, the fourth case member being attached to the first case member so as to form a second air-tight pump chamber for containing the second pump mechanism therein and attached to the third case member so as to form a third air-tight pump chamber for containing the third pump mechanism therein, wherein the fourth case member is provided with a through-hole at a position axially aligned with a second outlet port of the second pump mechanism and a first inlet port of the third pump mechanism so that the through-hole is connected to both the second outlet port of the second pump mechanism and the first inlet port of the third pump mechanism and wherein a first outlet port and a second inlet port of the second pump mechanism are in flow communication with the second pump chamber while a first outlet port and a second inlet port of the third pump mechanism are in flow communication with the third pump chamber.

8. An air pump apparatus according to claim 7, further comprising a fourth pump mechanism having an identical configuration to the first pump mechanism and attached to a second surface of the base plate of the third case member with a first inlet port of the fourth pump mechanism being connected to the through-hole of the base plate of the third case member, wherein the pump case assembly further comprises a fifth case member attached to the second surface of the base plate of the third case member so as to form a fourth air-tight pump chamber for containing the fourth pump mechanism therein, wherein the fifth case member is provided with a through-hole at a position axially aligned with a second outlet port of the fourth pump mechanism so that the through-hole is connected to the second outlet port of the fourth pump mechanism and wherein a first outlet port and a second inlet port of the fourth pump mechanism are in flow communication with the fourth pump chamber.

9. An air pump apparatus according to claim 1, further comprising a lid member disposed at an axial end of the air pump apparatus, the lid member comprising:

an air chamber holding a filter therein; and an air passage having one end connected to the air chamber and the other end connected to outside of the air pump apparatus.

10. An air pump apparatus according to claim 9, wherein the air chamber of the lid member is axially aligned with the first inlet port and the second outlet port of the first pump mechanism.

11. An air pump apparatus according to claim 10, wherein the lid member is disposed such that air is taken into the air pump apparatus via the air passage and the filter of the lid member.

12. An air pump apparatus according to claim 10, wherein the lid member is disposed such that air is discharged from the air pump apparatus via the filter and the air passage of the lid member.

13. An air pump apparatus according to claim 12, wherein the air passage of the lid member extends generally perpendicularly to the axial direction so that the other end of the air passage is located on a side of the air pump apparatus.

14. An air pump apparatus according to claim 2, wherein the first pump mechanism is attached to the base plate of the first case member by means of an axially extending joint member that is made of electrically conductive material so that electric power is supplied to the electromagnetic drive means of the first pump mechanism via the joint member.

15. An air pump apparatus according to claims 5, wherein the first and second pump mechanisms are attached to the base plate of the first case member by means of an axially extending joint member that is made of electrically conductive material so that electric power is supplied from a common power source to the electromagnetic drive means of the first and second pump mechanisms via the joint member.

16. An air pump apparatus according to claim 1, wherein the electromagnetic drive means of the first pump mechanism comprises an electromagnet disposed longitudinally alongside the base frame and a pair of arms which are vibrated substantially symmetrically in accordance with alternation of a magnetic field generated by the electromagnet and connected to the first and second diaphragms respectively.

17. An air pump apparatus according to claim 1, wherein the second inlet port of the first pump mechanism is defined in the first end of the base frame and the first outlet port of the first pump mechanism is defined in the second end of the base frame.

18. An air pump apparatus according to claim 4, wherein the through-hole of the base plate of the first case member is defined by a tubular port having a first edge axially projecting from the first surface of the base plate of the first case member and a second edge axially projecting from the second surface of the base plate of the first case member, the first edge of the tubular port being adapted to be fittingly engageable with the second outlet port of the first pump mechanism and the second edge of the tubular port being adapted to be fittingly engageable with the first inlet port of the another pump mechanism.

19. A diaphragm-type pump mechanism, comprising:

a base frame having a first end and a second end opposite to the first end, the first and second ends of the base frame defining an axial direction of the air pump mechanism;

mutually opposing first and second diaphragms defining first and second diaphragm chambers on lateral sides of the base frame respectively;

electromagnetic drive means for driving the first and second diaphragms so as to expand and contract the first and second diaphragm chambers;

a first inlet port defined in the first end of the base frame for communicating air into the first diaphragm chamber upon expansion of the first diaphragm chamber, with a first one-way valve being provided between the first inlet port and the first diaphragm chamber for permitting air flow only into the first diaphragm chamber;

a second inlet port defined in the base frame for communicating air into the second diaphragm chamber upon expansion of the second diaphragm chamber, a second one-way valve being provided between the second inlet port and the second diaphragm chamber for permitting air flow only into the second diaphragm chamber;

a first outlet port defined in the base frame for discharging air from the first diaphragm chamber upon contraction of the first diaphragm chamber, a third one-way valve being provided between the first outlet port and the first diaphragm chamber for permitting air flow only out of the first diaphragm chamber; and a second outlet port defined in the second end of the base frame for discharging air from the second diaphragm chamber upon contraction of the second diaphragm chamber, a fourth one-way valve being provided between the second outlet port and the second diaphragm chamber for permitting air flow only out of the second diaphragm chamber, and the second outlet port being in axial alignment with the first inlet port, wherein the electromagnetic drive means is disposed alongside the base frame.

20. A diaphragm-type pump mechanism according to claim 19, wherein the electromagnetic drive means comprises an electromagnet disposed longitudinally alongside the base frame and a pair of arms vibrated in accordance with alternation of a magnetic field generated by the electromagnet, the pair of arms being connected to the first and second diaphragms, respectively.

* * * * *